US011332690B2

(12) United States Patent
Baralt et al.

(10) Patent No.: US 11,332,690 B2
(45) Date of Patent: May 17, 2022

(54) BASE OILS AND METHODS OF MAKING THE SAME

(71) Applicant: Novvi LLC, Emeryville, CA (US)

(72) Inventors: Eduardo Baralt, Houston, TX (US); Jason Wells, Fremont, CA (US); Jason Charles Rosalli, Oakland, CA (US); Wui Sum Willbe Ho, Oakland, CA (US); Liwenny Ho, Oakland, CA (US); Benton Thomas, Elizabethtown, NC (US)

(73) Assignee: NOVVI LLC, Emeryville, CA (US)

( * ) Notice: Subject to any disclaimer, the term of this patent is extended or adjusted under 35 U.S.C. 154(b) by 0 days.

(21) Appl. No.: 16/630,324

(22) PCT Filed: Jul. 13, 2018

(86) PCT No.: PCT/US2018/401993
§ 371 (c)(1),
(2) Date: Jan. 10, 2020

(87) PCT Pub. No.: WO2019/014540
PCT Pub. Date: Jan. 17, 2019

(65) Prior Publication Data

US 2020/0165538 A1 May 28, 2020

Related U.S. Application Data

(60) Provisional application No. 62/532,773, filed on Jul. 14, 2017.

(51) Int. Cl.
*C10M 177/00* (2006.01)
*C07C 2/14* (2006.01)
(Continued)

(52) U.S. Cl.
CPC ..... *C10M 177/00* (2013.01); *C10G 11/05* (2013.01); *C10M 105/04* (2013.01);
(Continued)

(58) Field of Classification Search
None
See application file for complete search history.

(56) References Cited

U.S. PATENT DOCUMENTS 4,284,522 A 8/1981 Olmsted
4,910,355 A * 3/1990 Shubkin ..... C07C 9/22 585/255
(Continued)

FOREIGN PATENT DOCUMENTS

EP 1969607 B1 3/2010
EP 2236590 10/2010
(Continued)

OTHER PUBLICATIONS

Patent Cooperation Treaty, International Search Report for PCT/US2018/041981, 6pgs. dated Nov. 26, 2018.
(Continued)

*Primary Examiner* — Philip Y Louie
(74) *Attorney, Agent, or Firm* — Bryan Cave Leighton Paisner LLP

(57) ABSTRACT

A process for the preparation of saturated hydrocarbon base oils is provided, comprising oligomerization of a feed mixture that has an average carbon number in the range of 14 to 18 to produce an oligomer product comprising dimers, trimers, and higher oligomers, where the dimer has a branching proximity (BP) of 20 or greater, isomerization of at least the dimer portion, and hydrogenation of the isomerized product. The dimer portion is separated from the oligomer product, and a saturated hydrocarbon base oil is obtained comprising greater than 90% dimers having an average
(Continued)

carbon number in the range of from 29 to 36, and the dimer portion having a weight average molecular weight in the range of 422 to 510, where the dimers have an average Branching Index (BI) in a range of 22 to 26 and an average paraffin branching proximity (BP) in a range of from 18 to 26.

15 Claims, 6 Drawing Sheets

(51) Int. Cl.

| | |
|---|---|
| ***C07C 5/03*** | (2006.01) |
| ***C07C 5/27*** | (2006.01) |
| ***C10G 11/05*** | (2006.01) |
| ***C10M 105/04*** | (2006.01) |
| *C10N 30/00* | (2006.01) |
| *C10N 30/02* | (2006.01) |

(52) U.S. Cl.
CPC . *C10G 2300/4081* (2013.01); *C10G 2400/10* (2013.01); *C10M 2203/024* (2013.01); *C10N 2030/02* (2013.01); *C10N 2030/74* (2020.05)

(56) References Cited

U.S. PATENT DOCUMENTS

| | | | |
|---|---|---|---|
| 5,105,039 | A | 4/1992 | Pelrine |
| 5,132,477 | A | 7/1992 | Ho et al. |
| 5,264,642 | A | 11/1993 | Wu |
| 5,767,047 | A | 6/1998 | Duncan et al. |
| 5,817,899 | A | 10/1998 | Hope et al. |
| 5,922,658 | A | 7/1999 | Duncan et al. |
| 6,313,077 | B1 | 11/2001 | Stunnenberg et al. |
| 6,398,986 | B1 | 6/2002 | McShane |
| 7,456,329 | B2 | 11/2008 | Wu et al. |
| 7,544,850 | B2 | 6/2009 | Goze et al. |
| 7,691,792 | B1 | 4/2010 | Fisher et al. |
| 7,795,484 | B2 | 9/2010 | Koivusalmi |
| 8,124,820 | B2 | 2/2012 | Tiitta et al. |
| 8,268,199 | B1 | 9/2012 | Forest |
| 9,266,793 | B2 | 2/2016 | Gee |
| 10,501,670 | B2 | 12/2019 | Hahn et al. |
| 2001/0001804 | A1* | 5/2001 | Skledar ..... C10M 105/04 585/250 |
| 2002/0139962 | A1 | 10/2002 | Fefer et al. |
| 2006/0027361 | A1 | 2/2006 | Hanson et al. |
| 2007/0225534 | A1 | 9/2007 | Goze et al. |
| 2007/0259792 | A1 | 11/2007 | Null |
| 2007/0299291 | A1 | 12/2007 | Koivusalmi |
| 2008/0146469 | A1 | 6/2008 | Sato et al. |
| 2008/0283803 | A1 | 11/2008 | Rapp |
| 2009/0036337 | A1 | 2/2009 | Deskin et al. |
| 2009/0137435 | A1 | 5/2009 | Hilker |
| 2009/0181871 | A1 | 7/2009 | Shah et al. |
| 2009/0326296 | A1 | 12/2009 | Brillantes et al. |
| 2010/0048438 | A1 | 2/2010 | Carey et al. |
| 2010/0059725 | A1 | 3/2010 | Sinclair et al. |
| 2010/0152072 | A1 | 6/2010 | Nelson et al. |
| 2011/0195884 | A1 | 8/2011 | Crouthamel et al. |
| 2011/0287988 | A1 | 11/2011 | Fisher et al. |
| 2011/0288256 | A1 | 11/2011 | Vermeiren |
| 2011/0306529 | A1 | 12/2011 | Schober et al. |
| 2012/0071367 | A1 | 3/2012 | Falana et al. |
| 2012/0119862 | A1 | 5/2012 | Franklin et al. |
| 2012/0209039 | A1 | 8/2012 | Wright |
| 2012/0323055 | A1 | 12/2012 | Gruber et al. |
| 2013/0090273 | A1 | 4/2013 | Martin et al. |
| 2013/0217606 | A1 | 8/2013 | Wang et al. |
| 2013/0253244 | A1 | 9/2013 | Emett et al. |
| 2013/0267450 | A1 | 10/2013 | Patil et al. |
| 2014/0194333 | A1 | 7/2014 | Dance et al. |
| 2014/0323665 | A1 | 10/2014 | Wu et al. |
| 2015/0322365 | A1 | 11/2015 | Jeon et al. |
| 2016/0264493 | A1 | 9/2016 | Small et al. |
| 2017/0121630 | A1 | 5/2017 | Vettel et al. |
| 2017/0130161 | A1 | 5/2017 | Vettel et al. |
| 2017/0240832 | A1 | 8/2017 | Hahn et al. |
| 2017/0305819 | A1 | 10/2017 | Wells et al. |
| 2018/0119033 | A1 | 5/2018 | Tirmizi et al. |
| 2019/0264112 | A1 | 8/2019 | Tirmizi et al. |
| 2019/0264122 | A1 | 8/2019 | Rosalli et al. |
| 2019/0338211 | A1 | 11/2019 | Baralt et al. |
| 2020/0095177 | A1 | 3/2020 | Baralt et al. |
| 2020/0165538 | A1 | 5/2020 | Baralt et al. |
| 2020/0216772 | A1 | 7/2020 | Baralt et al. |

FOREIGN PATENT DOCUMENTS

| | | |
|---|---|---|
| EP | 3052600 | 8/2016 |
| JP | 2008115301 | 5/2008 |
| WO | 9810042 | 3/1998 |
| WO | 0026925 | 5/2000 |
| WO | 03020856 | 3/2003 |
| WO | 2007140339 | 12/2007 |
| WO | 2010115097 | 10/2010 |
| WO | 2012141783 | 10/2012 |
| WO | 2012141784 | 10/2012 |
| WO | 2013101414 | 7/2013 |
| WO | 2013130372 | 9/2013 |
| WO | 2014128227 A1 | 8/2014 |
| WO | 2014154802 A1 | 10/2014 |
| WO | 2016182930 | 11/2016 |

OTHER PUBLICATIONS

Patent Cooperation Treaty, International Search Report for PCT/US2018/041993, 6pgs. dated Nov. 29, 2018.

Smith et al., Vitamin E. XLII. Long Chain Aliphatic Compounds with Recurring "Isoprene" Units, J. Am. Chem. Soc., 1943, 65 (5), pp. 745-750 May 12, 1943.

Challener, C., Base oils 2014: Green lubricants continue progress, ICIS Chemical Business, retrieved from www.icis.com/resources/news/2014/02/11/9752026/base-oils-2014-green-lubricants-continue-progress/, 8 pages Feb. 11, 2014.

Cooper, Tim, Industrial Lubricants 2008, retrieved from energy.org.il/wp-content/uploads/2017/01/nrg510.pdf 2006.

Hernaindez/-Torres et al., Stereocontrolled generation of the (2R) chroman core of vitamin E: total synthesis of (2R,4'RS,8'RS)-alpha-tocopherol, Organic Letters, 2009, 11(21): 4930-4933 2009.

Sinnenghe Damste et al., The identification of 2,3-dimethyl-5-(2,6,10-trimethylundecyl)thiophene, a novel sulphur containing biological marker, Tetrahedron Letters, 1987, 28(9): 957-960 1987.

Odinokov et al., New Enantiospecific synthesis of (+)-2R,6R)-(+)-2,6,10-Trimethylundecan-1-ol for constructing the side chain of natural (2R,4'5,8'R)-(+)-[alpha]-Tocopherol (Vitamin E), Doklady Chemistry, Kluwer Academic Publishers-Plenum Publishers, NE, 2005,403(4-6): 144-147 2005.

Ineos, Safety Data Sheet DURASYN 125 Polyalphaolefin, 11 pages, retrieved from www.ineos.com/products/?fs=Polyalphaolefin%2b(PAO)%2b-%2bLow%2bViscosity Mar. 5, 2021.

Dong et al., Preparation and Characterization of Single-Component Poly-α-olefin Oil Base Stocks, Energy & Fuels, 33: 9796-9804 2019.

Kapur et al., Detailed characterisation of polyalphaolefins and their branched structures using multi-pulse NMR techniques, Journal of Synthetic Lubrication, 15(3): 177-191 1998.

* cited by examiner

1-C10 Trimer PAO Hydrocarbon Chain
BI= 19.4
BP= 3

GTL Hydrocarbon Chain
BI= 19.4
BP= 26.7

BI= 24.2
BP= 20.0

BASE OILS AND METHODS OF MAKING THE SAME

FIELD OF THE INVENTION

Aspects of present disclosure generally relate to synthetic hydrocarbon base oils. Described herein are isoparaffin oligomers derived from alpha-olefins and/or linear internal olefins with improved low temperature properties by catalytic isomerization of the oligomers. The resulting product may be capable of providing an excellent lubricant base oil.

BACKGROUND

The automotive industry is placing greater demands on engine oils, operating at higher temperatures for longer times and requiring lower viscosity engine oil formulations such as 0W-30 and 0W-20 engine oils. These lower weight engine oils improve vehicle fuel economy by lowering friction losses. This desire for lower weight engine oils is driving a demand for low viscosity PAOs, such as those around 4 cSt kinematic viscosity. Allowing for engine oils with decreased viscosity while maintaining low Noack volatility and good low-temperature performance properties.

Poly Alpha Olefins (PAOs) and Poly Internal Olefins (PIOs) make up important classes of hydrocarbon lubricating oils. They are typically produced by the polymerization of alpha-olefins or internal-olefins in the presence of a Friedel Crafts catalyst such as $AlCl_3$, $BF_3$, or $BF_3$ complexes. For example, 1-octene, 1-decene, 1-dodecene, and 1-tetradecene have been used to manufacture PAOs. C8-C18 internal olefins have been used to manufacture PIOs. Fractionation and hydrogenation typically follow oligomerization of the olefins to remove any remaining unsaturated monomer moieties.

The poly alpha olefin products are typically obtained with a wide range of viscosities varying from low molecular weight and low viscosity of about 2 cSt at 100° C., to higher molecular weight, viscous materials which have viscosities exceeding 100 cSt at 100° C. The poly alpha olefins may be produced by the polymerization of olefin feed in the presence of a catalyst, such as, $AlCl_3$, and $BF_3$ complexes. Processes to produce poly alpha olefin lubricants are disclosed, for example, in U.S. Pat. Nos. 3,382,291; 4,172,855; 3,742,082; 3,780,128; 3,149,178; 4,956,122; and 5,082,986. Poly alpha olefins and poly internal olefins lubricants are discussed in Synthetic Lubricants and High-Performance Functional Fluids, Revised and Expanded. Edited by Leslie R. Rudnick and Ronald L. Shubkin CRC Press 1999. The polymerization reaction is typically conducted in the absence of hydrogen; the lubricant range products are thereafter polished or hydrogenated to reduce the residual unsaturation.

Prior efforts to prepare various PAOs that can meet the increasingly stringent performance requirements of modern lubricants and automotive engine oil particularly have favored low viscosity polyalphaolefin base oils derived from 1-decene alpha-olefins, alone or in some blend with other mineral, or Fischer-Tropsch derived base oils. However, the polyalphaolefins derived from 1-decene can be prohibitively expensive and its supply is limited. Thus, a need exists for low viscosity base oils which are made from olefins other than 1-decene and that exhibit properties such as relatively low Noack volatility, calculated according to ASTM D 5800 Standard Test Method for Evaporation Loss of Lubricating Oils by the Noack Method, low cold-crank viscosity (i.e. dynamic viscosity according to ASTM D 5293, CCS), and/or additional SAE 0W low temperature viscometric requirements.

The properties of a particular grade of PAO are typically dependent on the alpha olefin feedstock used to make that product. Commercially, some C28 to C36 oligomers of alpha olefins are made from a mixed feed of C8, C10 and C12 alpha olefins, with 1-decene being incorporated for the purpose of imparting the most desirable properties.

In contrast, 4 cSt PAOs and PIOs made without decene have yielded base oils lacking in one or more important physical properties (e.g., viscosity index, Noack volatility, and low temperature CCS). Thus, PAOs made from C8 through C12 mixed alpha-olefin feeds, such as the C28 to C36 oligomers may have the advantage that they lower the amount of decene that is needed to impart predetermined properties. However, they still do not completely remove the requirement for providing decene as a part of the oligomer, in order to impart the appropriate physical properties. Therefore, there is a need for products that incorporate alpha olefins other than C8, C10 and C12, to make polyolefin base oils.

Poly internal-olefins (PIOs) are typically produced by the polymerization of internal-olefins in the presence of a Friedel Crafts catalyst such as $AlCl_3$, $BF_3$, or $BF_3$ complexes. C8-C18 internal olefins have been used to manufacture PIOs. Oligomerization of these olefins is typically followed by fractionation and hydrogenation to remove any remaining unreacted hydrocarbons and unsaturated moieties. Such PIOs have been prepared with properties including 4.33 cSt viscosity at 100° C., 20.35 Vis at 40° C., 122 Viscosity Index, pour point of −51° C. and Noack volatility of 15.3 (Data taken from Synthetic Lubricants and High-Performance Functional Fluids, Revised and Expanded. Edited by Leslie R. Rudnick and Ronald L. Shubkin CRC Press 1999.) This product has excellent low pour point, but the VI is too low, and the Noack Volatility too high, for modern 0W engine oils. Therefore, a need for a non-1-decene based polyolefin exists in the market.

Other examples of processes for making PIOs can be found, for example, in EP 1,104,747, EP 0,776,960, and U.S. Pat. No. 4,910,355.

Furthermore, conventional processes to make these PAOs and PIOs may also result in the production of significant quantities of cross-oligomers that do not have the desired properties for a 4 cSt base oil. Accordingly, narrow distillation cuts must typically be taken to select only the oligomers having the desired properties, resulting in undesirably low yields of functional product.

Therefore, there remains a need for a base oil composition having properties within commercially acceptable ranges for physical properties including one or more of the viscosity, Noack volatility, and low temperature cold-cranking viscosity, for use for example in automotive and other applications. Furthermore, there remains a need for base oil compositions having improved properties and methods of manufacture thereof, where the base oil compositions have reduced amounts of 1-decene incorporated therein, and may even preferably eliminate the use of 1-decene in the manufacture thereof.

Large quantities of poly alpha olefins are used in a variety of lubricating applications. However, PAOs existing in the market today are derived from fossil fuels. Another potential source for making polyolefin base oils is from renewable sources. Therefore, it is desirable to produce base oils and PAOs from renewable sources. Alpha olefins can be made via dehydration of a fatty alcohol.

Naturally occurring sources of said renewable alcohols do not have high concentration of C8-C12 length alcohols, and instead have a high concentration of alcohols in the range of C14-C18. Previous attempts to use linear alpha olefins in the C14-C18 range, without 1-decene, made poly alpha olefins with unacceptably high pour points lubricants, i.e. higher than −24° C., that are unsuitable for use in a variety of different lube oils, including 0W engine oils. High pour points increase the cold-cranking viscosity at −35° C. (ASTM D5293-02). Accordingly, there is a need for polyolefins with low enough pour points that the cold-cranking viscosities are suitable for 0W engine oils, while exhibiting volatilities that are acceptable.

Up to now, however, commercially successful poly alpha olefin base oils have been limited to those comprising C8, C10 and C12 linear alpha-olefins. No commercial process has been demonstrated to convert other olefins to polyolefins with advantageously low pour points, CCS at −35° C., and low Noack volatility properties for PAO based lubricant oils. Aspects of the present disclosure are directed to overcoming this and other deficiencies in the art.

SUMMARY OF THE INVENTION

Aspects of the present disclosure relate to a process for the manufacture of branched saturated hydrocarbons, which may be suitable for use as synthetic base oils or base oil components. In accordance with aspects of the present disclosure, a new alternative process has been discovered for producing polyolefin base oils from olefins, such as from alpha-olefins, or mixtures of alpha and internal-olefins, as well as optionally internal-olefins. C14 to C18 alpha or internal-olefins are used in this process as the primary feedstocks for oligomer manufacturing, thereby easing the demand for high price 1-decene and other crude oil or synthetic gas based olefins as feedstocks, and making available alternate sources of olefin feedstocks such as those derived from C14-18 alcohols. Provided herein are also base oils and lubricant compositions derived from one or more olefin co-monomers, where said olefin co-monomers are oligomerized to dimers, trimers, and higher oligomers. In a preferred embodiment, the process according to aspects of the disclosure isomerizes at lease the dimer portion of the oligomers. The resulting dimers have excellent pour point, volatility and viscosity characteristics and additive solubility properties.

Briefly, in a first aspect of the present disclosure, a process for preparing a C14 to C18 olefin oligomer with excellent low temperature properties is provided, comprising: forming a reaction mixture of an oligomerization catalyst system and a C14 to C18 olefin monomer feed mixture, polymerizing the olefin monomer feed in the reaction mixture to produce an oligomer product. In one embodiment, the dimer portion produced by the oligomerization has a branching proximity of 20 or greater. At least the dimer portion of the oligomerization product is isomerized in the presence of an acid catalyst. The isomerized oligomer product is hydrogenated, and the dimer fraction can be separated, such as by distillation, such that a polyolefin lubricant composition comprising an average carbon number in the range of C29-C36 is obtained. In one embodiment, the resulting polyolefin base oil may have a weight average molecular weight between 422 and 510, and pour point of −27° C. or below, having a kinematic viscosity at 100° C. in the range of from about 3.7 to about 4.8 cSt, with a branching index (BI) greater than 22, but less than 26, a Noack weight loss in the range of from about 6 to about 14%, and a viscosity index greater than 124.

Other aspects, features and embodiments of the present disclosure are provided in the following description.

DETAILED DESCRIPTION

Figure 1:
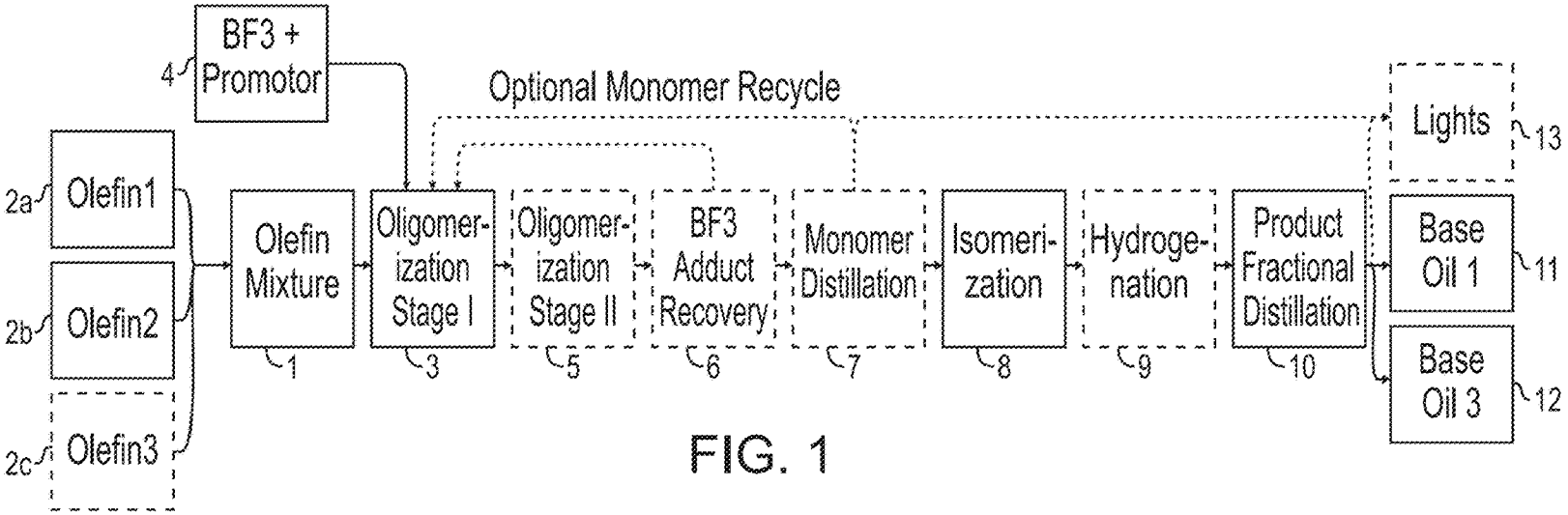
FIG. 1 is a block diagram illustrating a process embodiment including: a 1-stage and optionally a 2-stage oligomerization reaction, recycling of the unreacted monomer back into the 1st stage of the oligomerization process, hydrogenation of the oligomers, and fractional distillation to separate the oligomers into 1 or even 2 base oil distillate cuts (a and b bottoms product).
Figure 2:
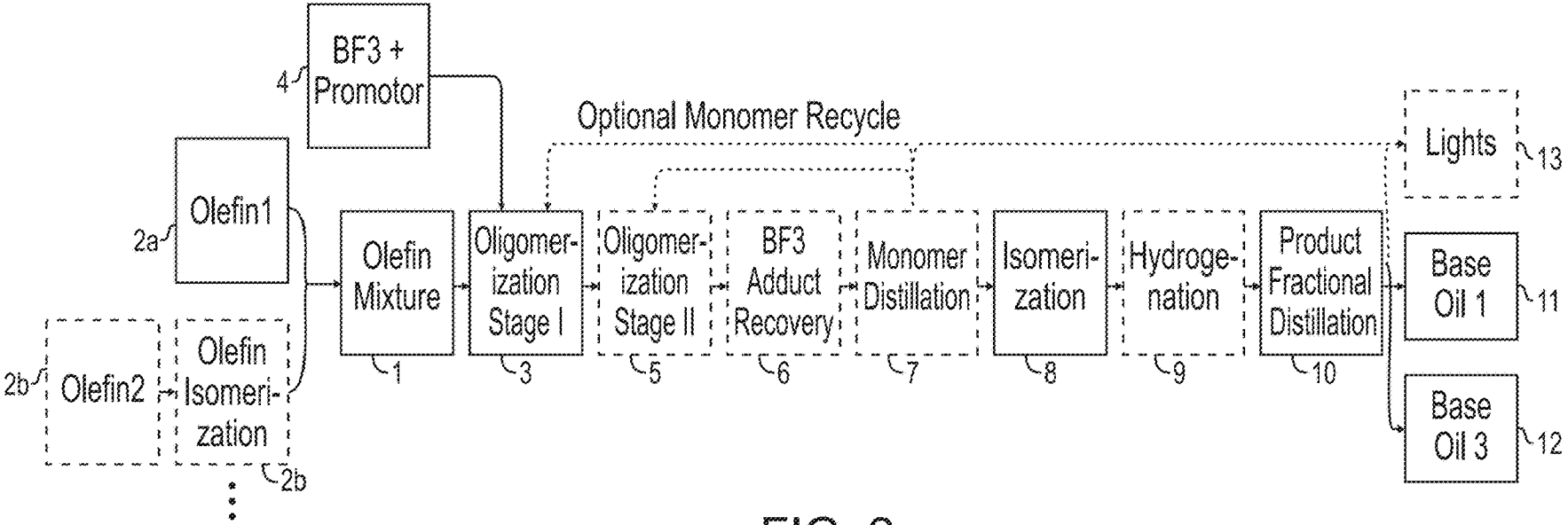
FIG. 2 shows a block diagram showing a process embodiment including the preparation of an internal olefin feedstock by the catalytic isomerization of a linear alpha olefin, and the optional distillation of an unsaturated monomer co-product.

According to aspects of the disclosure, olefin oligomers are obtained by providing at least one C14-C18 olefin monomer, or a mixture of two or more of said olefin monomers (e.g., as shown in box 1 of FIGS. 1 and 2). The olefin monomer can also be prepared by providing linear or branched alpha olefins (such as C14-C18 branched alpha olefin monomers), or optionally a linear or branched internal olefin. The olefin monomer is oligomerized, for example either with itself, or with a second olefin (e.g., as shown in boxes 2*a*-2*c* of FIGS. 1 and 2), which may be an internal olefin monomer having a different chain length and/or different average double bond position, and/or may be a C14 to C18 alpha olefin monomer, such as a linear alpha-olefin monomer. In one embodiment, where one of the olefin monomers used to form the oligomer is a C14 alpha olefin monomer, the other olefin monomer may have a chain length greater than C14. For example, if a C14 linear alpha olefin monomer is used as the first olefin, the second olefin monomer may comprise a C15 to C18 linear alpha olefin monomer. In the process embodiment shown in FIG. 1, one or more olefin feeds (e.g., Olefins 1, 2 and 3 in boxes 2*a*-2*c*), are combined together to form the olefin mixture in box 1, where the one or more olefin feeds can comprise alpha olefins, and/or may in certain embodiments comprise internal olefins. In the process embodiment shown in FIG. 2, at least one of the olefin feeds is subjected to an isomerization process to result in an isomerized olefin (e.g., Olefin Isomerization in box 2*b*) having an isomerized double bond position, and this isomerized olefin feed can be optionally combined with another olefin feed (e.g., Olefin 1 in box 2), to provide the olefin mixture in box 1. The olefin mixture of box 1 may be exposed to Boron Trifluoride and an alcohol or ester promoter in an oligomerization stage, as shown in boxes 3 and 5 of FIGS. 1 and 2, to form an oligomer from the olefin monomer mixture in reaction vessel shown in box 1 of FIGS. 1 and 2. Optionally a second stage reactor can be used to further react the olefin mixture under different reaction conditions as shown in box 5 of FIGS. 1 and 2, and may provide a dimer portion of the oligomer product that has a branching proximity of 20 or greater. The $BF_3$ promotor adduct may be separated and recycled back to the oligomerization reactor as shown in box 6 of FIGS. 1 and 2. The unreacted monomer can be removed, and optionally recycled back into the starting olefin mixture, as shown in box 7 of FIGS. 1 and 2, or collected as an unsaturated co-product. In one embodiment, the resulting mixture of oligomers is isomerized to increase the degree of branching as shown in box 8 of FIGS. 1 and 2, and hydrogenated, as shown in box 9 of FIGS. 1 and 2. The dimer fraction may be separated therefrom, as shown in box 10 to produce a hydrocarbon base oil with desirable physical properties for use as an engine oil base oil, such as properties suitable for 0W formulations and above, as shown in box 11. A bottoms product may be recovered as shown in box 11 suitable as a higher viscosity blend stock for engine oil applications or a base oil for higher viscosity industrial or other vehicle lubricants. Optionally a saturated or unsaturated lights co-product may be recovered as shown in box 13. In one embodiment, the resulting dimer may have a KV100 between 3.7 and 4.8 cSt, with a viscosity index of 125 or greater, with a pour point between −27° C. and −45° C., with a CCS at −35 C of less than 1800 cP, and a Noack volatility of less than 14%.

Aspects of the present disclosure relate to a method for making saturated C28-C36 hydrocarbons useful for engine oil applications. In one embodiment, olefins ranging from 14 to 18 carbons in size are exposed to a strong Lewis acid catalyst such as $BF_3$ coupled with a promoter molecule. According to one embodiment, the unreacted monomer is distilled off, and the resulting oligomers are further isomerized in the absence of hydrogen. The dimers may be separated by distillation, and have ideal properties for use in an engine oil formulation, with a relatively high VI, low CCS, low Noack, and low Pour Point.

Feedstock Selection

In one embodiment, a feed alpha olefin, such as C14 to C18, can be either an alpha olefin, or may be an olefin feed that has been produced by isomerizing an alpha olefin to form an internal olefin prior to oligomerization, via selective internal isomerization of the α-olefin using a catalyst (which may be an inexpensive catalyst), and under isomerization conditions that may inhibit olefin deterioration and side reactions, such as skeletal isomerization, oligomerization, and cracking.

Aspects of the disclosure relate to the surprising discovery that an oligomer derived from C14-C18 alpha olefins and/or internal olefins can have the desired viscosity, Noack volatility, and/or low temperature CCS viscosity, such as values of these properties that are within commercially preferred ranges. According to aspects of the disclosure, by controlling the oligomerization reaction conditions and the degree of branching through isomerization of the oligomers, a mixture of C14-C18 olefins, such as olefins selected from the group consisting of 1-tetradecene, 1-pentadecene, 1-hexadecene, 1-heptadecene, 1-octadecene, (and/or optionally branched structural isomers of these olefins) and/or internal olefins derived from linear internal or branched internal pentadecenes, hexadecenes, heptadecenes and octadecenes, can produce dimers offering excellent low temperature performance, high viscosity index, and low volatility. In one embodiment, the olefin monomers of the feed mixture may be selected from the group consisting of unsaturated, linear alpha-olefins, unsaturated, linear internal olefins, branched alpha olefins, branched internal olefins, and combinations thereof. In yet another embodiment, the olefin monomers of the feed mixture may comprise a mixture of linear alpha olefins and/or linear internal olefins. According to certain embodiments, the longer linear paraffin branches produced from C14-C18 olefins increases the VI and reduce the CCS of the oligomers, while the pour point of the oligomers can be reduced by the introduction of branching through isomerization of the dimer.

In one embodiment of the disclosure, the feedstocks used to form the oligomers are C14 to C18 olefins comprising less than 36% by weight of branched olefins. In yet another embodiment, the feedstock used to form the oligomers are C14 to C18 olefins comprise less than 20% by weight of branched olefins monomers. In yet another embodiment, the feedstocks used to form the oligomers are C14 to C18 olefins comprise less than 10% by weight of branched olefins. In yet another embodiment, the feedstock used to form the oligomers are C14 to C18 olefins comprise less than 5% by weight of branched olefins.

Furthermore, in one embodiment, an amount of decene in the feedstock mixture is less than 20% by weight. In yet another embodiment, an amount of decene in the feedstock mixture is less than 10% by weight. In yet another embodiment, an amount of decene in the feedstock mixture is less than 5% by weight. In yet another embodiment an amount of decene in the feedstock mixture is less than 1% by weight.

In some variations, about 100% of the carbon atoms in the olefin feedstocks described herein originate from renewable carbon sources. In some variations, about 100% of the carbon atoms in the olefin co-monomer originate from renewable carbon sources. For example, an alpha-olefin co-monomer may be produced by oligomerization of ethylene derived from dehydration of ethanol produced from a renewable carbon source. In other variations, at least 90%, and even at least 95% of the carbon atoms in the renewable feedstocks originate from renewable carbon sources.

In some variations, alpha olefin monomers may be produced by dehydration of a primary alcohol other than ethanol that is produced from a renewable carbon source. In one embodiment, the C14 to C18 alpha olefin monomers used as feedstocks for the oligomerization are derived from the dehydration of C14 to C18 primary alcohols selected from the group consisting of 1-tetradecanol, 1-pentadecanol, 1-hexadecanol, 1-heptadecanol, and 1-octadecanol. In yet another embodiment, C14 to C18 primary alcohols are converted to the C14 to C18 alpha olefin monomers, and isomerized to form the isomerized C14 to C18 olefin monomer of the feed-stock product by exposure to a di-functional catalyst (e.g., a catalyst capable of both dehydrating the primary alcohols to form alpha olefin monomers, and isomerizing the alpha-olefin monomers to internal olefins).

In some embodiments, hydrocarbon terpene feedstocks derived from renewable resources are coupled with one or more olefins that are derived from renewable resources.

Oligomerization Process

According to one embodiment of the process of forming the oligomer composition, an alpha olefin [e.g., 1-tetradecene] is either mixed with an alpha or internal olefin [e.g. 3-hexadecene internal olefin], or polymerized solely (i.e. with itself) by either by semi-batch or continuous mode in a single stirred tank reactor, and/or by continuous mode in a series of stirred tank reactors using catalysts such as $BF_3$ and/or $BF_3$ promoted with a mixture of linear alcohol and an alkyl acetate ester.

Figure 3:
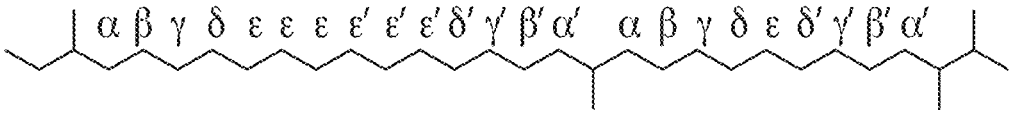
FIG. 3. Carbon labeling representation for a representative example of isomers of a GTL C30H62 paraffin used for lubricant applications.

In one embodiment, the oligomerization reaction conditions are controlled to impart a defined amount of isomerization, and to produce an at least partially branched unsaturated oligomer. That is, the oligomerization process conditions may be selected to not only oligomerize, but also at least partially isomerize, with the isomerization being controlled to a predetermined extent to avoid excessive branching of the dimer product at the oligomerization stage. In one embodiment, any isomerization occurring during oligomerization is controlled such that the dimer product resulting from the oligomerization has an average branching proximity (BP), of 20 or greater, and even 22 or greater. The branching proximity is a measure of the % equivalent recurring methylene carbons in the dimers, which are four or more removed from a carbon end group or branching carbon group (e.g., the epsilon carbons as shown in FIG. 3), and may be determined according to the following formula:

$$\text{paraffin branching proximity (BP)} = (\text{number of } \varepsilon \text{ carbon groups/total number of carbon groups}) * 100,$$

where an ε carbon group is defined as a carbon group that is separated from any terminal carbon atom groups or branching carbon groups by at least 4 carbon groups. That is, higher branching proximities may indicate a more linear molecule and/or longer hydrocarbon chains between branches (e.g., more recurring methylene carbons), whereas lower branching proximities may indicate more branching in the molecule and/or shorter hydrocarbon chains between branches (e.g., fewer recurring methylene carbons). Note that the branching proximity (BP) is typically measured for a saturated compound, and thus any calculation of branching proximity of the dimer product produced in the oligomerization step would involve hydrogenation of the dimer product prior to branching proximity (BP) measurement. That is, in order to determine the branching proximity (BP) of the dimers produced in the oligomerization process itself (i.e., without any subsequent isomerization), the dimers may be hydrogenated to a Bromine Index below 1000 mg $Br_2$/100 g as determined in accordance with ASTM D2710-09. However, as described in further detail below, in preparing a base oil comprising dimers according to aspects of the present disclosure, the oligomerized dimer product may be subject to further isomerization post-oligomerization, and prior to hydrogenation, to achieve the product. That is, while hydrogenation of the oligomerized dimers can be performed for the purposes of determining the branching proximity (BP) achieved after an oligomerization process, embodiments of the disclosure provide that a final saturated hydrocarbon base oil is prepared by performing hydrogenation only after a subsequent isomerization process post-oligomerization has been performed.

In one embodiment, the mixture of C14 to C18 olefin monomers are oligomerized in the presence of $BF_3$ and/or $BF_3$ promoted with a mixture of an alcohol and/or an ester, such as a linear alcohol and an alkyl acetate ester, using a continuously stirred tank reactor with an average residence time of 60 to 400 minutes. In another embodiment, the C14 to C18 olefin monomers are oligomerized in the presence of $BF_3$ and/or promoted $BF_3$ using a continuously stirred tank reactor with an average residence time of 90 to 300 minutes. In yet another embodiment, the C14 to C18 olefin monomers are oligomerized in the presence of $BF_3$ and/or promoted $BF_3$ using a continuously stirred tank reactor with an average residence time of 120 to 240 minutes. A temperature of the oligomerization reaction may be in a range of from 10° C. to 110° C.

Suitable Lewis acids catalysts for the oligomerization process include metalloid halides and metal halides typically used as Friedel-Crafts catalysts, e.g. $AlCl_3$, $BF_3$, $BF_3$ complexes, $BCl_3$, $AlBr_3$, $TiCl_3$, $TiCl_4$, $SnCl_4$, and $SbCl_5$. Any of the metalloid halide or metal halide catalysts can be used with or without a co-catalyst protic promoter (e.g. water, alcohol, acid, or ester). In one embodiment, the oligomerization catalyst is selected from the group consisting of zeolites, Friedel-Crafts catalysts, Bronsted acids, Lewis acids, acidic resins, acidic solid oxides, acidic silica aluminophosphates, Group IVB metal oxides, Group VB metal oxides, Group VIB metal oxides, hydroxide or free metal forms of Group VIII metals, and any combination thereof.

In one embodiment, the reaction mixture is distilled to remove the unreacted monomer. For example, the unreacted monomer may be separated from the oligomer product, such as via distillation, and can be recycled back into the mixture of the first and/or second feedstocks for oligomerization thereof. According to one aspect of the present disclosure, the unsaturated monomer free oligomer may be further isomerized without cracking in the absence of hydrogen, such as via isomerization in the presence of a catalyst.

Proper control of the oligomerization reaction conditions may be provided to ensure at least the dimer portion of the oligomers does not become too branched. In one embodiment, dimers resulting from oligomerization of C14-C18 olefins will have an average branching proximity (BP) of 20 or greater per 100 carbons. For example, if the dimers resulting from the oligomerization were to be hydrogenated to a Bromine Index below 1000 mg $Br_2$/100 g as determined in accordance with ASTM D2710-09, without a subsequent isomerizing step, the resulting hydrogenated dimers would exhibit an average paraffin branching proximity (BP) as determined by 13C NMR of 20 or greater per 100 carbons. In yet another embodiment, the dimers have an average branching proximity of 22 or greater. Dimers with lower branching proximity (below 20) as a result from isomerization during oligomerization may not maintain the necessary amount of linearity after the subsequent isomerization, and thus may exhibit excessive branching of the final dimer product, and a base oil with an excessively low VI (<124) and a dynamic viscosity that is undesirably high (>1800 cP).

In another embodiment, the unsaturated oligomer product is fractionated by distillation to remove the unreacted monomer portion, and the dimers and heavier oligomers are isomerized simultaneously.

Isomerization Process

In one embodiment, the oligomer product is next subjected to isomerization. Isomerization can be achieved either under hydrogen atmosphere (hydroisomerization), or in the absence of hydrogen. Isomerization (either in the presence or absence of hydrogen) can introduce additional branching through the rearrangement of the oligomer molecular structure, which may be critical to reducing pour point and improving low temperature fluidity. A hydroisomerization process requires hydrogen, and typically requires a high pressure and prior catalyst activation. Accordingly, in certain embodiments a non hydroisomerization process may be preferred because of the resulting improved product distribution, product quality, lower capital cost of process equipment, simplicity of operation, and high efficiency.

In one embodiment, any isomerization catalyst that is conventionally used for isomerization processes may be used. In one aspect, an acid catalyst for isomerization can be homogeneous acid catalysts, such as $AlCl_3$, $BF_3$, halides of Group IIIA, or modified form of these catalysts, or other typical Friedel-Crafts catalysts, such as the halides of Ti, Fe, Zn, and the like. The acid catalyst can also be selected from the group consisting of solid metals or metal oxides or their mixture of Group IVB, VB, VIB and Group III; metal oxides or mixed oxides of Group IIA to VA; other mixed metal oxides (such as $WOx/ZrO_2$ type catalyst), solid natural or synthetic zeolites, and layered material, crystalline or amorphous material of silica, alumina, silicoaluminate, aluminophosphate, aluminum silicophosphate. These solid acidic catalysts may also contain other Group VIII metals such as Pt, Pd, Ni, W, etc., as promoters. Generally, it is preferred to use a solid, regenerable catalyst for process economic reason and for better product quality. The preferred catalysts include: ZSM-5, ZSM-11, ZSM-20, ZSM-22, ZSM-23, ZSM-35, ZSM-48, zeolite beta, MCM22, MCM49, MCM56, SAPO-11, SAPO-31, zeolite X, zeolite Y, USY, REY, M41S and MCM-41, $WOx/ZrO_2$, etc. The solid catalyst can be used by itself or co-extruded with other binder material. Typical binder material includes silica, alumina, silicoalumina, titania, zirconia, magnesia, rare earth oxides, etc. The solid acidic catalyst can be further modified by Group III metals, such as Pt, Pd, Ni, W, etc. The modification can be carried out before or after co-extrusion with binder material. Sometimes the metal modification provides improvement in activity, sometimes it is not necessary. An example of discussion of catalysts and their preparation can be found in U.S. Pat. No. 5,885,438 which is incorporated herein by reference. Furthermore, in one embodiment the catalyst provided during isomerization is a different catalyst than that provided during oligomerization, for example to provide for differing extents and types of isomerization that what may occur during the oligomerization process.

In one embodiment, the acid catalyst provided for isomerizing the unsaturated polyolefin produced in the oligomerization process is a zeolite having a Constraint Index of about 2 to about 12. In another embodiment, the acid catalyst provided for isomerizing the unsaturated polyolefin produced in the oligomerization process is a zeolite containing one or more Group VI B to VIII B metal elements.

In one embodiment, the isomerization can be carried out in any of a fixed-bed, continuous operation, in batch type operation or in continuous stir tank operation. Generally, the residence time of the oligomer product under the isomerization conditions (e.g., residence time in fixed-bed reactor) may range from a few seconds to up to one or two days depending on reaction temperature, catalyst activity and catalyst particle size. For economic reasons, it may be preferred to use shorter residence times, if sufficient isomerization can be achieved to give improved properties. In one embodiment, residence time of 10 minutes to 20 hours residence time may be suitable.

In one embodiment, the isomerization is conducted at temperatures in the range of about 200° C. to about 400° C., and preferably at about 225° C. to about 300° C., and at pressures of about 0 kPa to about 13.79 MPa (about 0 psi to about 2,000 psi) and preferably about 35.5 kPa (about 15 psi) (atmospheric pressure) to about 6.895 MPa (about 1,000 psi), and even in a range of from 6.89 kPa (1 psi) to 689 kPa (100 psi). During the isomerization, the hydrocarbon cracking may be minimal, and even less than <1%, and so overall yield loss may be reduced while maintaining desired base oil properties (Vis, VI, CCS at −35 100° C. and PP).

In one embodiment, the pour point of the isomerized product is at least −9° C. less than that of the oligomer product prior to isomerization. In yet another embodiment, the pour point of the isomerized product is at least −15° C. less than that of the oligomer product prior to isomerization. In yet another embodiment, the pour point of the isomerized product is at least −21° C. less than that of the oligomer product prior to isomerization.

Cracked byproducts, naphthalenes and aromatics compounds can be formed during the isomerization of the oligomerized olefin. Naphthenic compounds are cyclic saturated hydrocarbons, also known as cycloparaffins. Naphthenic compounds may contain one ring structure (monocycloparaffins) or two rings (dicycloparaffins) or several rings (multicycloparaffins).

It is preferred that cracked hydrocarbons, naphthalenes and aromatic compounds are not formed, or are only formed in trivial amounts, during the isomerization of polyolefins, as they can adversely affect conversion and properties of the final product, specially viscosity index (VI), oxidation stability and Noack volatility. In one embodiment, the oligomers formed from C14 to C18 olefin monomers are isomerized under conditions wherein the amount of cracked byproducts generated during isomerization are less than 10% by weight. In another embodiment, the oligomers formed from C14 to C18 olefin monomers are isomerized under conditions wherein the amount of cracked byproducts generated during isomerization are less than 5% by weight. In yet another embodiment, the oligomers formed from C14 to C18 olefin monomers are isomerized under conditions wherein the amount of cracked byproducts generated during isomerization are less than 1% by weight. In yet another embodiment the isomerized oligomers contain less than 5% naphthalenes by weight. In another embodiment, the isomerized oligomers contain less than 2.5% naphthalenes by weight. in yet another embodiment the isomerized oligomers contain less than 1% naphthalenes by weight. In yet another embodiment, a base oil product comprising the dimers formed by the oligomerization and isomerization, may comprise the cracked byproducts in a wt % that is the same or less than the amount generated during the isomerization. For example, in one embodiment, the base oil can comprise cracked byproducts generated during isomerization that are less than 10% by weight of the base oil. In another embodiment, the base oil comprises cracked byproducts generated during isomerization than are less than 5% by weight of the base oil. In yet another embodiment, the base oil comprises of cracked byproducts generated during isomerization are less than 1% by weight of the base oil. In yet another embodiment the base oil contains less than 5% naphthalenes by weight. In another embodiment, the contains less than 2.5% naphthalenes by weight. In yet another embodiment the base oil contains less than 1% naphthalenes by weight.

In one embodiment, the isomerization reaction has a relatively high conversion rate for conversion of dimers to isomerized dimer products. For example, according to one embodiment, a percent yield of isomerized dimers produced in the isomerization is greater than 90% by weight of the dimers. In another embodiment, a percent yield of isomerized dimers produced in the isomerization is greater than 95% by weight. In another embodiment, a percent yield of isomerized dimers produced in the isomerization is greater than 97.5% by weight. In another embodiment, a percent yield of isomerized dimers produced in the isomerization is greater than 99% by weight.

Hydrogenation Process

In one embodiment, the product of the isomerization process is next hydrogenated. For example, a palladium on carbon catalyst, or supported nickel, or other well-known hydrofinishing catalysts may be used. Hydrogenation conditions include can include, for example, temperatures of from about 25° C. to about 400° C., and hydrogen pressure of about 1 to about 100 atmospheres. The hydrogenated product generally has a low bromine index of less than about 1000 as measured by ASTM D2710-0.

As described in further detail below, in one embodiment, the isomerization is followed by hydrogenation of the branched hydrocarbons produced in the isomerization process. For example, hydrogenation may be performed to achieve a hydrogenated product having a bromine index of less than 1000 mg Br/100 g (ASTM D2710-09). Hydrogenation processes are described in, e.g., see U.S. Pat. Nos. 7,022,784 and 7,456,329, which are incorporated herein by reference.

In a further embodiment, the oligomer product is hydrogenated to form a saturated oligomer product comprising a mixture of branched saturated hydrocarbons including hydrogenated dimer, trimer, and higher oligomers. According to one aspect, the mixture of branched saturated hydrocarbons is hydrogenated to the extent that the Bromine Index is below 1000 mg $Br_2$/100 g, as measured by ASTM D2710-0.

Base Oil

In one embodiment, the dimer portion of the hydrogenated oligomer product is separated from the remaining oligomer product, such as for example by taking one or more distillation cuts of the hydrogenated oligomer product.

In one embodiment, the saturated hydrocarbon base oil comprises greater than 90 wt % of the dimers, with the dimers having an average carbon number in the range of from 29 to 36, and the dimer portion having a weight average molecular weight in the range of from 422 to 510. Furthermore, according to embodiments herein, the dimers of the saturated base oil can comprise an average branching index (B)) as determined by 1H NMR that is in the range of 22 to 26, and an average paraffin branching proximity (BP) as determined by 13C NMR in a range of from 18 to 26. The average paraffin branching proximity (BP) is discussed above, and is a measure of the content of recurring methylene groups in the dimer portion. The branching index is a measure of the extent of branching, and can be determined according to the following formula:

Branching index (BI)=(total content of methyl group hydrogens/total content of hydrogens)*100

It has unexpectedly been discovered that, by controlling conditions during the base oil production process, including the oligomerization and isomerization steps, to provide a dimer product with branching characterized by the branching index and/or branching proximity described herein, a base oil product can be achieved with improved physical properties that may be suitable for automotive engine oil and other applications. Further detail regarding the properties of the base oil is described below.

To further clarify aspects of the present disclosure, it is noted that PAO dimers made from C14-C18 alpha olefins (i.e., without exposure to an isomerization catalyst post-oligomerization) may have relatively high pour points which can prevent them from being used in engine oil formulations. Comparative Example A is a dimer of C14 and C16 alpha olefins that was hydrogenated without exposure to an isomerizing Zeolite catalyst, and which has a BI of 22.51 and a branch proximity of 22.28; the pour point is −27° C. and a CCS at −35° C. of 2322 cP. Example 2 according to aspects of this disclosure is a dimer of same ratio of C14 to C16 alpha olefins as Comparative Example A, but which has been further isomerized by exposure to a Zeolite catalyst before hydrogenation, and which after hydrogenation exhibits a BI of 23.96 and a BP of 20.49; consequently, the pour point is −36° C. and a CCS at −35° C. of 1795 cP. This demonstrates that the isomerization process improves the pour point and CCS of the product.

In one embodiment, the isomerization of the oligomerized product produces an oligomer that, after hydrogenation and distillation, has a paraffin branching proximity (BP) of greater than 18 and less than 26 per 100 carbons and with branching index (BI) between 22 and 26 per 100 carbons. For a base oil and/or dimer product having branching proximity and branching index within these ranges, sufficient long chain branches remaining intact, while branching is also provided to a sufficient extent, resulting in a base oil with a viscosity index greater than about 125, with a pour point below −27° C., and CCS at −35° C. of less than 1800 cP.

Figure 4:
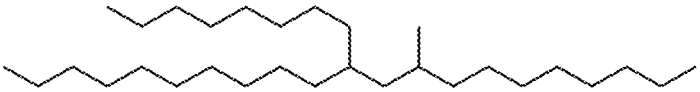
FIG. 4. Representative example of 1-Decene trimer 4 cSt PAO.
Figure 5:
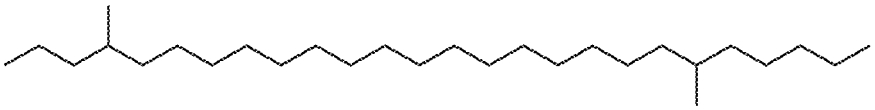
FIG. 5. Representative example of a 4 cSt base oil typical of a isodewaxed oils or Gas to liquids (GTL) base oils.
Figure 6:
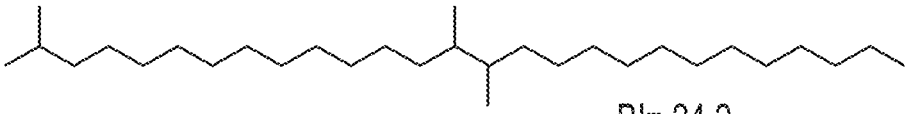
FIG. 6. The reaction process for a representative example of an isomerized 4 cSt 1-tetradecene and 1-hexadecene 4 cSt Dimer.
Figure 7:
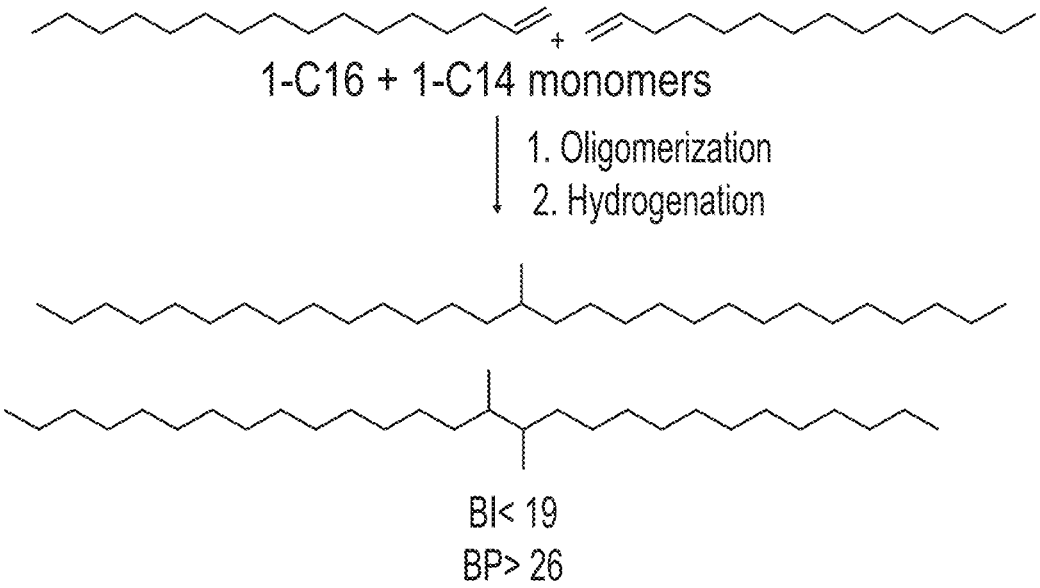
FIG. 7. Branching index (BI) for an embodiment of a hydrogenated 1-tetradecene and 1-hexadecene dimer 4 cSt polyolefin lube oil made without isomerization.
Figure 8:
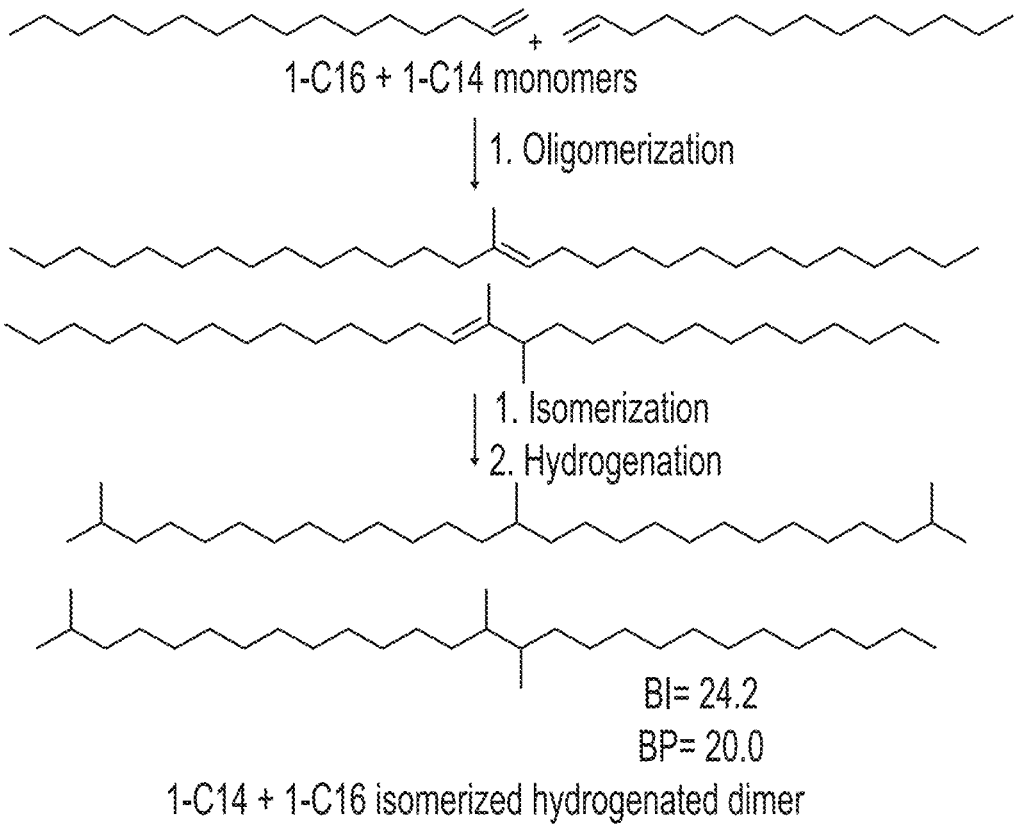
FIG. 8. Embodiments of isomerization and hydrogenation of C14 and C16 olefins dimers.
Figure 9:
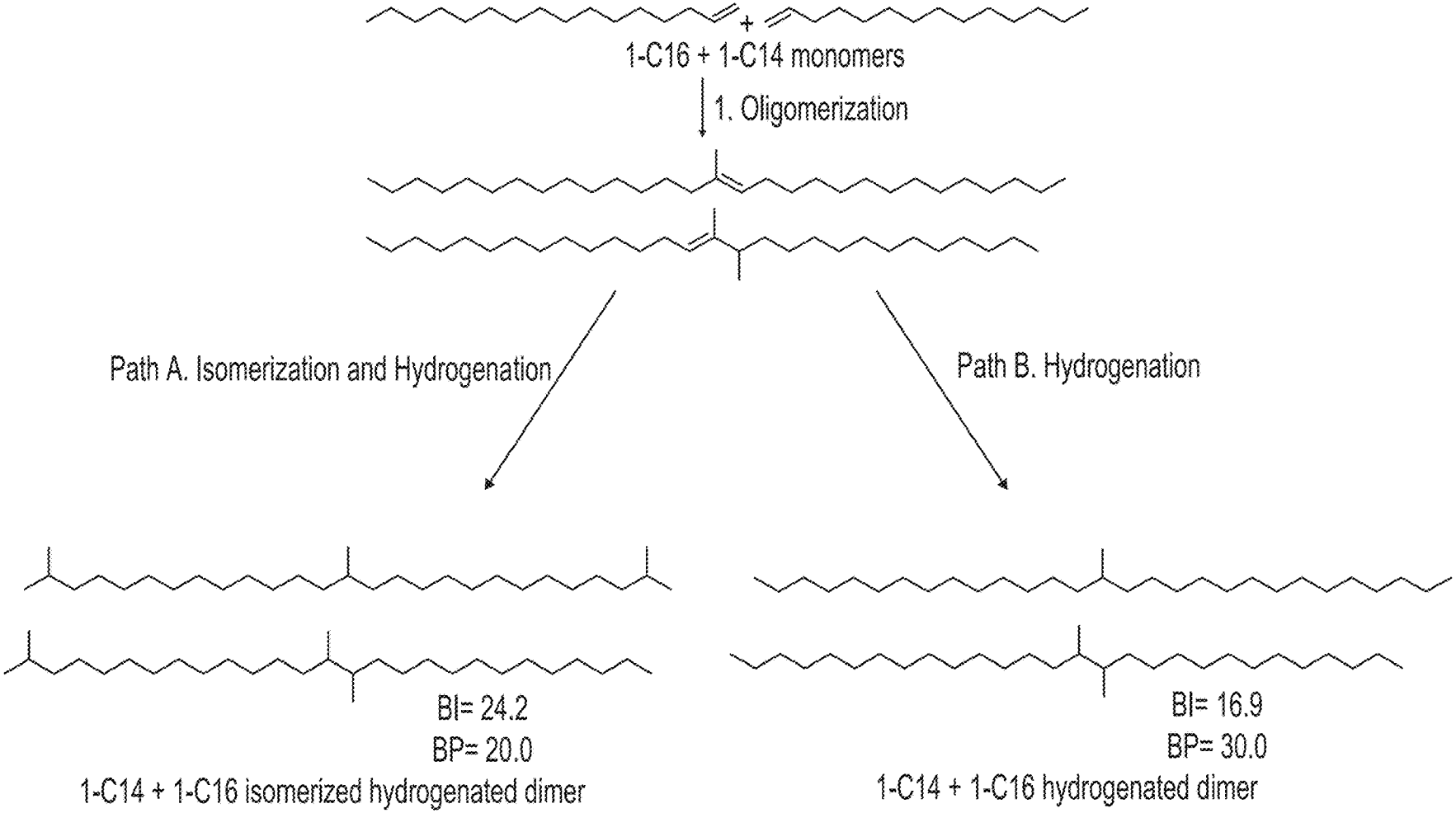
FIG. 9. Illustrates an embodiment of oligomerization of alpha olefins, followed by either (A) both isomerization followed by hydrogenation of the oligomer product, or (B) hydrogenation alone.

An example of a resulting isomer structure can be seen in FIG. 6, with a representative process shown in FIG. 8. In this structure, a branching index (BI) is 24.2 per 100 carbons and a branching proximity (BP) is 20.0 per 100 carbons. By contrast, FIG. 7 demonstrates a process and product by oligomerization and hydrogenation of C14 and C16 dimers, without a separate isomerization process, which results in less branched structures having a lower branching index of less than 19, and a higher branching proximity of greater than 26. Similarly, referring to FIG. 4, a conventional 1-decene trimer has a lower branching index of 19.4 and a lower branching proximity of 3, whereas, referring to FIG. 5, an oligomer produced by Fisher-Tropsch synthesis has a lower branching index of 19.4, and a higher branching proximity of 26.7. FIG. 9 further demonstrates the results for a process that performs isomerization prior to hydrogenation (path A), versus a process that only performs hydrogenation (path B). Accordingly, providing a dimer product with the branching proximity (BP) and/or branching index (BI) as described herein, such as via isomerization processes performed post-oligomerization and prior to hydrogenation, can allow for production of a base oil having the improved physical properties.

In one embodiment, the dimer produced according to aspects of this disclosure, a C28 to C36 dimer, makes about a 4 cSt base oil and the physical properties of the composition may have similar and/or improved physical properties as those that have yet only been achievable using solely 1-decene, or PAOs or those that incorporate significant amounts of 1-decene as a feedstock, such as PAOs derived from a mixed alpha-olefin feed of C10/C12, C8/C10/C12, C10/C12/C14 (i.e., cross-oligomers of C10 and C12, and cross-oligomers of C8, C10 and C12). For example, aspects of the disclosure may provide a base oil comprising the dimer product with, e.g., about a 4 cSt KV100 base fluid, such as in a range of from about 3.7 to about 4.8 cSt, with excellent Noack volatility, such as less than 14%, less than 1800 CCS at −35° C. and viscosity index (VI) greater than 125.

Furthermore, according to one aspect, the base oil composition comprising the dimer is substantially absent of any 1-decene. For example, embodiments of the base oil may comprise less than 5% by weight of 1-decene in either monomer, dimer, or trimer form, as well as higher oligomer forms, such as less than 3% by weight of 1-decene, and even less than 1% by weight of 1-decene.

Previous attempts to utilize the long chain alpha olefins for a 4 cSt base fluid yielded hydrocarbon lubricants that were deficient in one or more necessary physical parameters and they are included here for comparison. Comparative Example A shows PAO made from C14 and C16 alpha olefins, where the oligomers are not isomerized, the product has a CCS at −35° C. of 2400 cP, that is too high to be desirable for engine oils application due to rapid gelation characteristics. Changing the C14 and C16 content can help reduce the pour point, as shown by Reference A in the below table (from U.S. Pat. No. 4,218,330). However, the extra addition of C14 into the dimer is detrimental to the volatility as it is increased past the desirable range of <14%. Comparative Example B is made with C14 only dimers, and exhibits too low of a viscosity at 100° C., and too high a volatility, with its average carbon number of C28 below the desired C29-36 range without isomerization of the oligomers. Comparative Example C contains C16 alpha olefins only and has C32 average carbon length and an extremely low Noack volatility without isomerization of the oligomers. Instead, it has been discovered that oligomers of alpha-olefins with an average carbon number greater than about C12 require isomerization after oligomerization, as disclosed herein, to bring the cold temperature properties to a desirable range for engine oils. Surprisingly, by controlling the oligomer chain length, branching index, and branching proximity through isomerization of the oligomers, as in Example 1 and 2, oligomers from long chain LAOs can be prepared that exhibit desirable engine oil properties.

TABLE 1

Olefin feed ratio effect on the properties on the C14-C16 dimers.

| Example | Feed Olefins | 100° C. Viscosity, cSt | VI | Pour point, ° C. | Noack Volatility, % loss |
|---|---|---|---|---|---|
| Comparative Example A | C14/C16 30/70 | 4.13 | 128 | −27 | 12.6 |
| Example 1 | C14/C16 30/70 | 4.23 | 125 | −39 | 12.9 |
| Example 2 | C14/C16 30/70 | 4.24 | 128 | −35 | 13.2 |
| Reference A | C14/C16 68/32 | 4.15 | 137 | −25 | >15 |
| Comparative Example B | C14 100 | 3.81 | 134 | −30 | 16.1 |
| Comparative Example C | C16 100 | 4.38 | 151 | −15 | 6.4 |
| Example 3 | C16 100 | 4.02 | 131 | −33 | 13.9 |
| Example 4 | C16 100 | 4.01 | 132 | −30 | 13.3 |

For synthetic base oils such as PAO based on C8, C10, C12, or any combination of C8 through C12 alpha olefins, the Branching Index (BI) has been found to correlate with improved lubricant properties for hydrocarbon base oils. Specifically, commercial PAO base oils based on C8 through C12 alpha olefins, as shown in Reference B (Commercial sample of a 4 cSt PAO) in Table 2, require a Branching Index below about 22 to obtain desired properties. Oligomers from C8-C12 olefins with branching index greater than about 22 have excessive branching which constrains the lubricant properties, particularly with respect to viscosity index. Similarly, the Fischer-Tropsch process which produces gas to liquid (GTL) hydrocarbon lubricants with approximately 4 cSt at 100° c. among other viscosity products, seen in Reference C and D, it is preferred to have a branching index below 22 to achieve useful cold flow properties for an engine oil, as seen in U.S. Pat. No. 7,018,525. In contrast, as has been discovered herein, when using C14 or greater olefins, a branching index above 22 and a branching proximity of above 18 have been found to give superior lubricant properties, particularly with respect to VI, CCS at −35° c., and Noack volatility.

TABLE 2

Branching Index and average carbon number for samples of 4 cSt GTL, PAO and this invention.

| Sample # | Material id | Branching index | avg carbon number |
|---|---|---|---|
| Example 2 | C14/C16 isom | 23.96 | 30.8 |
| Reference B | GTL | 19.7 | 27.8 |
| Reference C | GTL | 19 | 27.4 |
| Reference D | C8/C10/C12 PAO | 21.8 | 32.4 |

TABLE 3

General comparison of 4 cSt C14-C16 dimer with PAO and GTL 4 cSt products.

| | BI | BP | VI | PP | NV | CCS @ −35 C. |
|---|---|---|---|---|---|---|
| Example 2 | 24 | 20 | 128 | <−33 | <13 | <1800 |
| PAO | ≤22 | <16 | 124-126 | <−54 | <14 | <1500 |
| GLT 4 | <20 | >26 | >140 | −27 | 14 | >1800 |

According to one embodiment, the saturated hydrocarbon base oil comprising the dimer product exhibits improved properties, such as volatility and cold temperatures properties suitable for use in automotive engine oil formulations. In one embodiment, the saturated hydrocarbon base oil comprising the dimer product exhibits a Noack Volatility as measured by ASTM D5800 that is less than 14%. In yet another embodiment, the saturated hydrocarbon base oil comprising the dimer product exhibits a Noack Volatility as measured by ASTM D5800 that is less than 13%. In yet another embodiment, the saturated hydrocarbon base oil comprising the dimer product exhibits a Noack Volatility as measured by ASTM D5800 that is less than 12%. In yet another embodiment, the saturated hydrocarbon base oil comprising the dimer product exhibits a Noack Volatility as measured by ASTM D5800 that is less than 11%. In yet another embodiment, the saturated hydrocarbon base oil comprising the dimer product exhibits a Noack Volatility as measured by ASTM D5800 that is less than 10%. In yet another embodiment, the saturated hydrocarbon base oil comprising the dimer product exhibits a Noack Volatility as measured by ASTM D5800 that is less than 9%. In yet another embodiment, the saturated hydrocarbon base oil comprising the dimer product exhibits a Noack Volatility as measured by ASTM D5800 that is less than 8%. In yet another embodiment, the saturated hydrocarbon base oil comprising the dimer product exhibits a Noack Volatility as measured by ASTM D5800 that is less than 7%. Generally, the Noack Volatility will be at least 6%.

According to yet another embodiment, the saturated hydrocarbon base oil comprising the dimer product exhibits a Pour Point as measured by ASTM D97-17 of less than −27° C. According to yet another embodiment, the saturated hydrocarbon base oil comprising the dimer product exhibits a Pour Point as measured by ASTM D97-17 of less than −30° C. According to yet another embodiment, the saturated hydrocarbon base oil comprising the dimer product exhibits a Pour Point as measured by ASTM D97-17 of less than −33° C. According to yet another embodiment, the saturated hydrocarbon base oil comprising the dimer product exhibits a Pour Point as measured by ASTM D97-17a of less than −36° C. According to yet another embodiment, the saturated hydrocarbon base oil comprising the dimer product exhibits a Pour Point as measured by ASTM D97-17a of less than −39° C. According to yet another embodiment, the saturated hydrocarbon base oil comprising the dimer product exhibits a Pour Point as measured by ASTM D97-17a of less than −42° C.

According to one embodiment, the saturated hydrocarbon base oil comprising the dimer product exhibits a Cold Crank Simulated (CCS) dynamic viscosity as measured by ASTM D5293 at −35° C. of 1800 cP or less. According to yet another embodiment, the saturated hydrocarbon base oil comprising the dimer product exhibits a Cold Crank Simulated (CCS) dynamic viscosity as measured by ASTM D5293-15 at −35° C. of 1700 cP or less. According to yet another embodiment, the saturated hydrocarbon base oil comprising the dimer product exhibits a Cold Crank Simulated (CCS) dynamic viscosity as measured by ASTM D5293-15 at −35° C. of 1600 cP or less. According to yet another embodiment, the saturated hydrocarbon base oil comprising the dimer product exhibits a Cold Crank Simulated (CCS) dynamic viscosity as measured by ASTM D5293-15 at −35° C. of 1500 cP or less. According to yet another embodiment, the saturated hydrocarbon base oil comprising the dimer product exhibits a Cold Crank Simulated (CCS) dynamic viscosity as measured by ASTM D5293-15 at −35° C. of 1400 cP or less. According to yet another embodiment, the saturated hydrocarbon base oil comprising the dimer product exhibits a Cold Crank Simulated (CCS) dynamic viscosity as measured by ASTM D5293-15 at −35° C. of 1300 cP or less. According to yet another embodiment, the saturated hydrocarbon base oil comprising the dimer product exhibits a Cold Crank Simulated (CCS) dynamic viscosity as measured by ASTM D5293-15 at −35° C. of 1200 cP or less According to yet another embodiment, the saturated hydrocarbon base oil comprising the dimer product exhibits a Cold Crank Simulated (CCS) dynamic viscosity as measured by ASTM D5293-15 at −35° C. of less than 1100 cP.

Furthermore, in one embodiment, the saturated hydrocarbon base oil comprising the dimer product exhibits a KV(100) as measured by ASTM D445-17a that is in the range of from 3.7 cSt to 4.8 cSt. In another embodiment, the saturated hydrocarbon base oil comprising of the dimer product exhibits a KV100 as measured by ASTM D445-17a is in the range of from 3.8 cSt to 4.5 cSt.

In another embodiment, the saturated hydrocarbon base oil comprising the dimer product exhibits a viscosity index as measured by ASTM D2270 of 125 or greater. In yet another embodiment, the saturated hydrocarbon base oil comprising the dimer product exhibits a viscosity index as measured by ASTM D2270 of 130 or greater. In yet another embodiment, the saturated hydrocarbon base oil comprising the dimer product exhibits a viscosity index as measured by ASTM D2270 of 135 or greater. In yet another embodiment, the saturated hydrocarbon base oil comprising the dimer product exhibits a viscosity index as measured by ASTM D2270 of 140 or greater. In yet another embodiment, the saturated hydrocarbon base oil comprising the dimer product exhibits a viscosity index as measured by ASTM D2270 of 150 or greater.

In yet another embodiment, the saturated hydrocarbon base oil has a Noack Volatility that is related to the KV100 by the following equation:

$$\text{Noack volatility} < -16.583(KV100)^2 + 125.36(KV100) + 223.8$$

In yet another embodiment, the CCS at −35 is related to the KV 100 by the following equation:

$$\text{CCS viscosity at } -35^\circ \text{ C.} < -1333.3(KV100)^2 + 11933(KV100) - 24900.$$

EXAMPLES

The following examples are meant to illustrate embodiments of the present disclosure, and it will be recognized by one of ordinary skill in the art in possession that numerous modifications and variations are possible. Therefore, it is to be understood that embodiments of the invention may be practiced otherwise than as specifically described herein.

Example 1

An olefin mixture of 30% 1-tetradecene and 70% 1-hexadecene with less than 8% branched and internal olefins was obtained, and the mixture was oligomerized under $BF_3$ pressure with a co-catalyst comprising a short chain alcohol and ester. Semi continuous addition of olefins and co-catalyst was used. The monomer was then distilled off and the bottoms were isomerized using a zeolite on alumina catalyst at 250° c. for 8 hours in a batch reactor. The isomerized oligomers were then hydrogenated to a Bromine Index of less than 1000 mg Br/100 g. The hydrogenated dimers were then distilled away from the trimer and heavier oligomers and had an average branching proximity of 22.3.

Example 2

Oligomerization reaction and feeds were carried out in accordance with Example 1. The remaining monomer was distilled off and the resulting oligomers were exposed to a zeolite on alumina catalyst at 270° c. for 8 hours in a batch reactor.

Example 3

A 1-hexadecene olefin feed with less than 8% branched and internal olefins was obtained. The 1-hexadecene feed was oligomerized under $BF_3$ pressure with a co-catalyst comprising of a short chain alcohol and ester. Semi continuous addition of olefins and co-catalyst was used. The unreacted monomer was then distilled off and the bottoms were isomerized using a zeolite on alumina catalyst at 290° C. for 4 hours in a batch reactor. The isomerized oligomers were then hydrogenated to a Bromine Index of less than 1000 mg Br/100 g. The Hydrogenated dimers were then distilled away from the trimer and heavier oligomers.

Example 4

Oligomerization feed and reaction was carried out in accordance with Example 3. The remaining monomer was distilled off and the resulting oligomers were exposed to a zeolite on alumina catalyst at 270° C. for 4 hours.

Definitions

Olefin

The term "Olefin" as used herein refers a hydrocarbon containing at least one carbon-carbon double bond. For example, according to aspects of the disclosure herein, an olefin may comprise a hydrocarbon chain length of from C14 to C18, and may have a double bond at an end (primary position) of the hydrocarbon chain (alpha-olefin) or at an internal position (internal-olefin). In one embodiment, the olefin is a mono-olefin, meaning that the olefin contains only a single double-bond group.

Alpha Olefins

The term "Alpha Olefin" as used herein refers an olefin that has a carbon-carbon double bond at an end of the olefin hydrocarbon chain (terminal position). For example, according to aspects of the disclosure herein, alpha olefins may comprise a hydrocarbon chain size of from C14 to C18, such as compounds having a chemical formula where the olefin has no more carbons than the specified carbon number of C14 to C18, e.g., C14H28, C16H32 and C18H36. In one embodiment, the alpha olefin is a mono-alpha-olefin, meaning that the alpha olefin contains only a single double-bond group.

Linear Alpha Olefin (LAO)

The term "Linear Alpha Olefin" as used herein refers an olefin that is linear (i.e., unbranched), and has a double bond at an end of the olefin hydrocarbon chain (terminal position). For example, according to aspects of the disclosure herein, alpha olefins may comprise a hydrocarbon chain length of from C14 to C18, such as compounds having a chemical formula where the olefin has no more carbons than the specified carbon number of C14 to C18, e.g., C14H28, C16H32 and C18H36. In one embodiment, the linear alpha olefin is a mono-alpha-olefin, meaning that the alpha olefin contains only a single double-bond group.

Internal Olefins

The term "Internal Olefin" as used herein refers an olefin that has an internal carbon-carbon double bond that is interior to the terminal end of the olefin hydrocarbon chain (e.g., at a position other than the alpha-position), and does not contain a carbon-carbon double bond at the terminal position. For example, according to aspects of the disclosure herein, internal olefins may comprise a hydrocarbon chain size of from C14 to C18, such as compounds having a chemical formula where the olefin has no more carbons than the specified carbon number of C14 to C18, e.g. C14H28, C16H32 and C18H36. In one embodiment, the internal olefin is a mono-internal-olefin, meaning that the internal olefin contains only a single double-bond group.

Linear Internal Olefins

The term "Linear Internal Olefin" as used herein refers an olefin that is linear (i.e., unbranched), and that has a carbon-carbon double bond that is interior to the terminal end of the olefin hydrocarbon chain (e.g., at a position other than the alpha-position), and does not contain a carbon-carbon double bond at the terminal position. For example, according to aspects of the disclosure herein, linear internal olefins may comprise a hydrocarbon chain length of from C14 to C18, such as compounds having a chemical formula where the olefin has no more carbons than the specified carbon number of C14 to C18, e.g. C14H28, C16H32 and C18H36. In one embodiment, the linear internal olefin is a mono-internal-olefin, meaning that the linear internal olefin contains only a single double-bond group.

Linear Mono-Olefins

Mixture of olefins or alkenes distinguished from other olefins with a similar molecular formula by linearity of the hydrocarbon chain length and a distribution of double bond positions in the molecule, from alpha to internal position. For example, according to aspects of the disclosure herein, linear mono-olefins may comprise a hydrocarbon chain length of from C14 to C18 with a chemical formula C14H28, C16H32, C18H36.

Isomerized Olefin

The term "Isomerized Olefin" is used herein to refer to an olefin feed and/or mixture that has been subjected to an isomerization process, such that an average double-bond position in the olefin and/or olefins feed has been shifted from a position close to or at the terminal double position (alpha position), to a distribution of cis/trans double bond positions more interior along the chain length. For example, in one embodiment, isomerized olefins can be formed by isomerization of linear alpha olefins (LAO), which have their double bond at the terminal end of the hydrocarbon chain, to linear internal olefins having an average double bond position more interior along the chain.

Branched Alpha-Olefins

The term "Branched Alpha-Olefin" is used herein to refer to an olefin that has alkyl (such as methyl or ethyl) branch groups along the hydrocarbon chain length of the olefin, and has a double bond at an end of the olefin hydrocarbon chain (primary position). For example, according to aspects of the disclosure herein, branched alpha olefins may comprise C14 to C18 olefins. In one embodiment, the branched alpha olefin is a mono-alpha-olefin, meaning that the branched alpha olefin contains only a single double-bond group.

Branched Internal Olefins

The term "Branched Internal-Olefin" is used herein to refer to an olefin that has alkyl (such as methyl or ethyl, or even longer) branch groups along the hydrocarbon chain length of the olefin, and has a double bond that is interior to the terminal end of the olefin hydrocarbon chain (e.g., at a position other than the alpha-position), and does not contain a carbon-carbon double bond at the terminal position. For example, according to aspects of the disclosure herein, branched internal olefins may comprise C14 to C18 olefins. In one embodiment, the branched internal olefin is a mono-alpha-olefin, meaning that the branched alpha olefin contains only a single double-bond group.

Dimer

The term "Dimer" as used herein refers to molecules formed by the combination of two monomers via a chemical process, where in monomers may be the same or different type of monomer unit. The dimer may be formed by chemical reaction and/or other type of bonding between the monomers. In one embodiment, a dimer is the product of oligomerization between two olefin monomers.

Oligomer

The term "oligomer" as used herein refers to a molecule having 2-100 monomeric units, and encompasses dimers, trimers, tetramers, pentamers, and hexamers. An oligomer may comprise one type of monomer unit or more than one type of monomer unit, for example, two types of monomer units, or three types of monomer units. "Oligomerization" as used herein refers to the formation of a molecule having 2-100 monomeric units from one or more monomers, and encompasses dimerization, trimerization, etc. of one type or different types of monomer, and also encompasses the formation of adducts and/or complexes between the same or more than one type of monomer.

Dimer Total Carbon Number

The term "Dimer Total Carbon Number" is used herein to refer to a total number of carbons in the dimer. Accordingly, a "C29-C36" dimer as referred to herein is a dimer have a total number of carbon atoms in a range of from 29 to 36.

Terpenes

The term "Terpenes" as used herein refers to compounds having multiples of units of isoprene, which has the molecular formula $C_5H_8$. The basic molecular formula of terpenes are multiples of that, $(C_5H_8)_n$ where n is the number of linked isoprene units, and terpenes can be derived biosynthetically from such units of isoprene. Monoterpenes consist of two isoprene units and have the molecular formula $C_{10}H_{16}$. Sesquiterpenes consist of three isoprene units.

Renewable

The term "Renewable" as used herein means any biologically derived composition, including fatty alcohols, olefins, or oligomers. Such compositions may be made, for nonlimiting example, from biological organisms designed to manufacture specific oils, as discussed in WO 2012/141784, but do not include petroleum distilled or processed oils such as, for non-limiting example, mineral oils. A suitable method to assess materials derived from renewable resources is through "Standard Test Methods for Determining the Biobased Content of Solid, Liquid, and Gaseous Samples Using Radiocarbon Analysis" (ASTM D6866-12 or ASTM D6866-11). Counts from $^{14}C$ in a sample can be compared directly or through secondary standards to SRM 4990C. A measurement of 0% $^{14}C$ relative to the appropriate standard indicates carbon originating entirely from fossils (e.g., petroleum based). A measurement of 100% $^{14}C$ indicates carbon originating entirely from modern sources (See, e.g., WO 2012/141784, incorporated herein by reference).

Base Oil

The term "Base Oil" as used herein refers an oil used to manufacture products including dielectric fluids, hydraulic fluids, compressor fluids, engine oils, lubricating greases, and metal processing fluids.

Viscosity Index

The term "Viscosity index" as used herein refers to viscosity index as measured according to "Standard Practice for Calculating Viscosity Index From Kinematic Viscosity at 40 and 100° C." (ASTM D2270) published by ASTM International, which is incorporated herein by reference in its entirety.

Kinematic Viscosity

The term "Kinematic Viscosity" as used herein refers to viscosities at 40° C. and at 100° C. measured according to "Standard Test Method for Kinematic Viscosity of Transparent and Opaque Liquids (and Calculation of Dynamic Viscosity)" (ASTM D445-17a) published by ASTM International, which is incorporated herein by reference in its entirety.

Cold-Cranking Simulator Viscosity

The term "Cold-Cranking Simulator Viscosity" (abbreviated CCS) refers to cold cranking simulator viscosity as measured according to "Standard Test Method for Apparent Viscosity of Engine Oils Between −5 and −35° C. Using the Cold-Cranking Simulator" (ASTM D5293) published by ASTM International, which is incorporated herein by reference in its entirety.

Pour Point

The term "Pour Point" refers to temperature at which a lubricant becomes semi solid and at least partially loses its flow characteristics, and is measured according to "Standard Test Method for Pour Point of Petroleum Products" (ASTM D97) published by ASTM International, which is incorporated herein by reference in its entirety.

Noack Volatility

The term "Noack Volatility" is used herein to a measure of evaporative weight loss as carried out according to "Standard Test Method for Evaporation Loss of Lubricating Oils by the Noack Method" (ASTM D5800), or "Standard Test Method for Evaporation Loss of Lubricating Oils by Thermogravimetric Analyzer (TGA) Noack Method" (ASTM D6375, TGA-Noack method), each published by ASTM International, and each of which is incorporated herein by reference in its entirety.

Bromine Index

The term "Bromine Index" is used herein to refer to a test for determining the degree of unsaturation of a product, such as a hydrogenated oligomer and/or dimer product, and can be determined in accordance with ASTM D2710-09, which is incorporated by reference herein in its entirety.

Branching Index (BI)

The term "Branching Index" is referred to herein as a measure of the percentage of methyl protons divided by the total number of protons (non-benzylic) in a sample, such as a sample comprising a dimer or oligomer. According to one embodiment, the Branching Index can be calculated using 1H NMR, by determining the percent of the non-benzylic methyl hydrogen content in the range of 0.5 to 1.05 ppm, per the total non-benzylic aliphatic hydrogen content in the range of 0.5 to 2.1 ppm. The formula for calculating the Branching Index is as follows:

Branching Index (BI)=(total content of methyl group hydrogens/total content of hydrogens)*100.

Measurement of the Branching Index is further described in U.S. Pat. Nos. 6,090,989 and 7,018,525, both of which are hereby incorporated by reference herein in their entireties.

Branch Proximity (BP)

The term "Branching Proximity" is used herein is used to refer to the % equivalent recurring methylene carbons, which are four or more removed from a carbon end group or branching carbon group (e.g., the epsilon carbons as shown in FIG. 3). In one embodiment, the Branching Proximity can be evaluated using 13C NMR, by measuring a peak corresponding to the recurring methylene carbons (e.g., at about 29.8 ppm), and determining the content as a percent of all carbon atoms measured in the 13C NMR spectrum. According to one aspect, the Branching Proximity may be determined according to the following formula:

Branching Proximity (BP)=(number of ε carbon groups/total number of carbon groups)*100, where an ε carbon group is defined as a carbon group that is separated from any terminal carbon atom groups or branching carbon groups by at least 4 carbon groups. Further description of the measurement of the Branching Proximity is described in U.S. Pat. No. 6,090,989, and further description of epsilon carbons is providing in U.S. 2008/0171675, both of which are hereby incorporated by reference herein in their entireties.

PIOs

PIOs refer to dimer, trimer or larger oligomer that is the product of an oligomerization which uses internal olefins as the feedstock.

PAOs

PAOs refer to dimer, trimer or larger oligomer that is the product of an oligomerization which uses alpha olefins as the feedstock.

Aspects of the invention may further be described with respect to the following embodiments:

Embodiment 1

A process for the preparation of a saturated hydrocarbon base oil, comprising:

forming an oligomerization reaction mixture comprising an oligomerization catalyst system and an olefin monomer feed mixture, wherein the olefin monomer feed mixture has an average carbon number in the range of 14 to 18;

oligomerizing the olefin monomer feed mixture in the reaction mixture to produce an oligomer product comprising dimers, trimers, and higher oligomers;

isomerizing at least the dimer portion of the oligomer product in the presence of an acid catalyst to form a mixture of branched hydrocarbons;

hydrogenating the isomerized branched hydrocarbons, to a Bromine Index below 1000 mg $Br_2$/100 g as determined in accordance with ASTM D2710-09; and separating the dimer portion of the hydrogenated oligomer product, whereby a saturated hydrocarbon base oil is obtained comprising greater than 90 wt % dimers having an average carbon number in the range of from 29 to 36, the dimer portion having a weight average molecular weight in the range of from 422 to 510, wherein the dimers of the oligomer product, in a case where the dimers are hydrogenated to a Bromine Index below 1000 mg $Br_2$/100 g as determined in accordance with ASTM D2710-09, without subsequent isomerizing, have an average paraffin branching proximity (BP) as determined by 13C NMR of 20 or greater, and wherein the isomerized and hydrogenated dimers of the saturated hydrocarbon base oil have an average branching index (BI) as determined by 1H NMR that is in the range of from 22 to 26, and an average paraffin branching proximity (BP) as determined by 13C NMR in a range of from 18 to 26, wherein the branching index (BI) is determined as follows:

branching index (BI)=(total content of methyl group hydrogens/total content of hydrogens)*100, and wherein the paraffin branching proximity (BP) is determined as follows:

paraffin branching proximity (BP)=(number of ε carbon groups/total number of carbon groups)*100, where an ε carbon group is defined as a carbon group that is separated from any terminal carbon atom groups or branching carbon groups by at least 4 carbon groups.

Embodiment 2

The process according to embodiment 1, wherein the oligomerization conditions during oligomerization result in dimers of the oligomer product that, in a case where the dimers are hydrogenated to a Bromine Index below 1000 mg $Br_2$/100 g as determined in accordance with ASTM D2710-09, without subsequent isomerizing, have an average a paraffin branching proximity (BP) of 22 or greater.

Embodiment 3

The process according to any preceding embodiment, comprising performing the isomerization after oligomerization of the olefin feed mixture had been performed.

Embodiment 4

The process according to any preceding embodiment, wherein at least a portion of the isomerization is performed simultaneously with oligomerization.

Embodiment 5

The process according to any preceding embodiment, wherein the olefin monomer feed mixture comprises a first feedstock comprising C14 to C18 alpha olefin monomers selected from the group consisting of tetradecene, pentadecene, hexadecene, heptadecene and octadecene.

Embodiment 6

The process according to any preceding embodiment, further comprising preparing an olefin monomer feed mixture comprising C14 to C18 alpha olefin monomers by dehydration of C14 to C18 primary alcohols selected from the group consisting of 1-tetradecanol, 1-pentadecanol, 1-hexadecanol, 1-heptadecanol and 1-octadecanol.

Embodiment 7

The process according to any preceding embodiment, wherein the olefin monomer feed mixture comprises olefin monomers selected from the group consisting of unsaturated, linear alpha-olefins; unsaturated, normal internal-olefins; branched alpha-olefins; branched internal-olefins; and combinations thereof.

Embodiment 8

The process according to any preceding embodiment, where the olefin monomer feed mixture comprises a mixture of linear alpha-olefins and/or linear internal-olefins.

Embodiment 9

The process according to any preceding embodiment, wherein the olefin monomer feed mixture comprises olefin monomers selected from the group consisting of unsaturated olefin comprises, linear alpha-olefins; linear internal-olefins; branched alpha-olefins; branched internal-olefins; and combinations thereof.

Embodiment 10

The process according to any preceding embodiment, wherein the olefin monomer feed mixture comprises a first feedstock comprises less than 36% by weight of branched olefin monomers.

Embodiment 11

The process of any preceding embodiment, wherein the olefin monomer feed mixture comprises a first feedstock comprising less than 20% by weight of branched olefin monomers.

Embodiment 12

The process of any preceding embodiment, wherein the olefin monomer feedstock comprises a first feedstock comprising less than 10% by weight of branched olefin monomers.

Embodiment 13

The process of any preceding embodiment, wherein the olefin monomer feedstock comprises a first feedstock comprising less than 5% by weight of branched olefin monomers.

Embodiment 14

The process of any preceding embodiment, wherein an amount of decene in any of first and/or second feedstocks of the olefin monomer feedstock is less than 20% by weight.

Embodiment 15

The process of any preceding embodiment, wherein an amount of decene in any of first and/or second feedstocks of the olefin monomer feedstock is less than 10% by weight.

Embodiment 16

The process of any preceding embodiment, wherein an amount of decene in any of first and/or second feedstocks of the olefin monomer feedstock is less than 5% by weight.

Embodiment 17

The process of any preceding embodiment, further comprising oligomerizing the olefin monomer feed under conditions to at least partially isomerize the dimers, trimers, and higher oligomers.

Embodiment 18

The process of any preceding embodiment, wherein the unreacted monomer is distilled from the unsaturated oligomers and recycled in a subsequent oligomerization reaction.

Embodiment 19

The process of any preceding embodiment, wherein isomerizing of the oligomer product is performed in the absence of hydrogen.

Embodiment 20

The process according to any preceding embodiment, wherein an amount of cracked byproducts generated during isomerizing of the oligomer product is less than 10%.

Embodiment 21

The process according to any preceding embodiment, wherein an amount of cracked byproducts generated during isomerizing of the oligomer product is less than 5%.

Embodiment 22

The process according to any preceding embodiment, wherein an amount of cracked byproducts generated during isomerizing of the oligomer product is less than 1%.

Embodiment 23

The process according to any preceding embodiment, wherein isomerizing of the oligomer product is performed at a temperature in the range of from 125° C. to 300° C., and a pressure in the range of from 1 PSI to 100 PSI of inert gas, in the presence of an acid catalyst selected from the group consisting of solid metals or metal oxides or their mixture of Group IVB, VB, VIB and Group III; metal oxides or mixed oxides of Group IIA to VA; mixed metal oxides comprising $WO_x/ZrO_2$ type catalyst; solid natural or synthetic zeolites; and layered material, crystalline or amorphous material of silica, alumina, silicoaluminate, aluminophosphate, aluminum silicophosphate.

Embodiment 24

The process according to any preceding embodiment, wherein the dimer portion of the isomerized oligomer product is separated by distillation from the isomerized oligomer product.

Embodiment 25

The process of any preceding embodiment where the oligomerization reaction is carried out at a temperature range from 10-110° C.

Embodiment 26

The process of any preceding embodiment, wherein the oligomerization catalyst is selected from the group consisting of zeolites, Friedel-Crafts catalysts, Bronsted acids, Lewis acids, acidic resins, acidic solid oxides, acidic silico aluminophosphates, Group IVB metal oxides, Group VB metal oxides, Group VIB metal oxides, hydroxide or free metal forms of Group VIII metals, and any combination thereof.

Embodiment 27

The process of any preceding embodiment, wherein the oligomerization reaction catalyst is $BF_3$, and the promoter is an alcohol and/or an ester.

Embodiment 28

The process of any preceding embodiment, wherein the oligomerization is carried out in at least one continuously stirred reactor under oligomerization conditions with an average residence time of 60 to 400 minutes.

Embodiment 29

The process of any preceding embodiment, wherein the oligomerization is carried out in at least one continuously stirred reactor under oligomerization conditions with an average residence time of 90 to 300 minutes.

Embodiment 30

The process of any preceding embodiment, wherein the oligomerization is carried out in at least one continuously stirred reactor under oligomerization conditions with an average residence time of 120 to 240 minutes.

Embodiment 31

The process of any preceding embodiment, wherein the acid catalyst used for isomerizing the unsaturated polyolefin is a zeolite having a Constraint Index of about 2 to about 12.

Embodiment 32

The process of any preceding embodiment, wherein the acid catalyst used for isomerizing the unsaturated polyolefin is a zeolite containing one or more Group VI B to VIII B metal elements.

Embodiment 33

The process of any preceding embodiment, wherein the pour point of the isomerization product is at least −9° C. less than that of the oligomer product prior to isomerization.

Embodiment 34

The process according to any preceding embodiment, wherein the pour point of the isomerization product is at least −15° C. less than that of the oligomer product prior to isomerization.

Embodiment 35

The process according to any preceding embodiment, wherein the pour point of the isomerization product is at least −21° C. less than that of the oligomerization product prior to isomerization.

Embodiment 36

The process according to any preceding embodiment, wherein the dimer product of the saturated hydrocarbon base oil has <5 wt % naphthalenes after isomerization and hydrogenation.

Embodiment 37

The process according to any preceding embodiment, wherein the dimer product of the saturated hydrocarbon base oil has <2.5 wt % naphthalenes after isomerization and hydrogenation.

Embodiment 38

The process of any preceding embodiment, wherein the dimer product of the saturated hydrocarbon base oil has <1 wt % naphthalenes after isomerization and hydrogenation.

Embodiment 39

The process of any preceding embodiment, wherein a percent yield of isomerized dimers produced in the isomerization is >90 wt. %.

Embodiment 40

The process according to any preceding embodiment, wherein a percent yield of isomerized dimers produced in the isomerization >95 wt. %.

Embodiment 41

The process according to any preceding embodiment, wherein a percent yield of isomerized dimers produced in the isomerization >97.5 wt. %.

Embodiment 42

The process according to any preceding embodiment, wherein a percent yield of isomerized dimers produced in the isomerization is >99 wt. %.

Embodiment 43

The process according to any preceding embodiment, wherein the base oil has a kinematic viscosity of measured at 100° C. by ASTM D445 of 3.7 cSt to 4.8 cSt.

Embodiment 44

The process according to any preceding embodiment, wherein the base oil has a kinematic viscosity of measured at 100° C. by ASTM D445 of 3.8 cSt to 4.5 cSt.

Embodiment 45

The process according to any preceding embodiment, wherein the saturated base oil has a Viscosity Index 125 or greater.

Embodiment 46

The process according to any preceding embodiment, wherein the saturated base oil has a Viscosity Index 130 or greater.

Embodiment 47

The process according to any preceding embodiment, wherein the base oil has a Viscosity Index 135 or greater.

Embodiment 48

The process according to any preceding embodiment, wherein the base oil has a Viscosity Index 140 or greater.

Embodiment 49

The process according to any preceding embodiment, wherein the base oil has a Viscosity Index of 150 or greater.

Embodiment 50

The process according to any preceding embodiment, wherein the base oil has a CCS at −35° C. less than 1800 cP.

Embodiment 51

The process according to any preceding embodiment, wherein the base oil has a CCS at −35° C. less than 1700 cP.

Embodiment 52

The process according to any preceding embodiment, wherein the base oil has a CCS at −35° C. less than 1600 cP.

Embodiment 53

The process according to any preceding embodiment, wherein the base oil has a CCS at −35° C. less than 1500 cP.

Embodiment 54

The process according to any preceding embodiment, wherein the base oil has a CCS at −35° C. less than 1400 cP.

Embodiment 55

The process according to any preceding embodiment, wherein the base oil has a CCS at −35° C. less than 1300 cP.

Embodiment 56

The process according to any preceding embodiment, wherein the base oil has a CCS at −35° C. less than 1200 cP.

Embodiment 57

The process according to any preceding embodiment, wherein the base oil has a CCS at −35° C. less than 1100 cP.

Embodiment 58

The process according to any preceding embodiment, wherein the base oil has a Noack volatility less than 14%.

Embodiment 59

The process according to any preceding embodiment, wherein the base oil can be characterized by a Noack volatility of less than 13%.

Embodiment 60

The process according to any preceding embodiment, wherein the base oil can be characterized by Noack volatility of less than 12%.

Embodiment 61

The process according to any preceding embodiment, wherein the base oil can be characterized by Noack volatility of less than 11%.

Embodiment 62

The process according to any preceding embodiment, wherein the base oil can be characterized by Noack volatility of less than 10%.

Embodiment 63

The process according to any preceding embodiment, wherein the base oil can be characterized by Noack volatility of less than 9%.

Embodiment 64

The process according to any preceding embodiment, wherein the base oil can be characterized by Noack volatility of less than 8%.

Embodiment 65

The process according to any preceding embodiment, wherein the base oil can be characterized by Noack volatility of less than 7%.

Embodiment 66

The process according to any preceding embodiment, wherein the base oil can be characterized by Noack volatility of less than 6%.

Embodiment 67

The process according to any preceding embodiment, wherein the base oil can be characterized by pour point of less than −27° C.

Embodiment 68

The process according to any preceding embodiment, wherein the base oil can be characterized by pour point of less than −30° C.

Embodiment 69

The process according to any preceding embodiment, wherein the base oil can be characterized by pour point of less than −33° C.

Embodiment 70

The process according to any preceding embodiment, wherein the base oil can be characterized by pour point of less than −36° C.

Embodiment 71

The process according to any preceding embodiment, wherein the base oil can be characterized by pour point of less than −39° C.

Embodiment 72

The process according to any preceding embodiment, wherein the base oil can be characterized by pour point of less than −42° C.

Embodiment 73

The process according to any preceding claim, where a catalyst provided during isomerization is other than a catalyst provided during oligomerization.

What is claimed:

1. A process for the preparation of a saturated hydrocarbon base oil, comprising:

forming an oligomerization reaction mixture comprising an oligomerization catalyst system and an olefin monomer feed mixture, wherein the olefin monomer feed mixture has an average carbon number in the range of 14 to 18;

oligomerizing the olefin monomer feed mixture in the reaction mixture in the presence of a $BF_3$ catalyst that causes isomerization to produce an oligomer product comprising a dimer portion comprising dimers, a trimer portion comprising trimers, and a higher oligomer portion comprising higher oligomers;

further isomerizing at least the dimer portion of the oligomer product in the presence of an acid catalyst to form a mixture of branched hydrocarbons;

hydrogenating the isomerized branched hydrocarbons, to a Bromine Index below 1000 mg $Br_2$/100 g as determined in accordance with ASTM D2710-09 to form a hydrogenated oligomer product; and separating the dimer portion of the hydrogenated oligomer product, whereby a saturated hydrocarbon base oil is obtained comprising greater than 90 wt % dimers having an average carbon number in the range of from 29 to 36, the dimer portion of the hydrogenated oligomer product having a weight average molecular weight in the range of from 422 to 510, wherein the dimers of the hydrogenated oligomer product, in a case where the dimers are hydrogenated to a Bromine Index below 1000 mg $Br_2$/100 g as determined in accordance with ASTM D2710-09, without subsequent isomerizing, have an average paraffin branching proximity (BP) as determined by 13C NMR of 20 or greater, and wherein the isomerized and hydrogenated dimers of the saturated hydrocarbon base oil have an average branching index (BI) as determined by 1H NMR that is in the range of from 22 to 26, and an average paraffin branching proximity (BP) as determined by 13C NMR in a range of from 18 to 26, wherein the branching index (BI) is determined as follows:

branching index (BI)=(total content of methyl group hydrogens/total content of hydrogens)*100, and wherein the paraffin branching proximity (BP) is determined as follows:

paraffin branching proximity (BP)=(number of ε carbon groups/total number of carbon groups)*100, where an ε carbon group is defined as a carbon group that is separated from any terminal carbon atom groups or branching carbon groups by at least 4 carbon groups.

2. The process according to claim 1, wherein the oligomerization conditions during oligomerization result in dimers of the oligomer product that, in a case where the dimers are hydrogenated to a Bromine Index below 1000 mg $Br_2$/100 g as determined in accordance with ASTM D2710-09, without subsequent isomerizing, have an average a paraffin branching proximity (BP) of 22 or greater.

3. The process according to claim 1 comprising performing the isomerization after oligomerization of the olefin monomer feed mixture had been performed; and/or i) wherein the olefin monomer feed mixture comprises a first feedstock comprising C14 to C18 alpha olefin monomers selected from the group consisting of tetradecene, pentadecene, hexadecene, heptadecene and octadecene; and/or ii) wherein the olefin monomer feed mixture comprises C14 to C18 alpha olefin monomers prepared by dehydration of C14 to C18 primary alcohols selected from the group consisting of 1-tetradecanol, 1-pentadecanol, 1-hexadecanol, 1-heptadecanol and 1-octadecanol; and/or iii) wherein the olefin monomer feed mixture comprises olefin monomers selected from the group consisting of unsaturated, linear alpha-olefins; unsaturated, normal internal-olefins; branched alpha-olefins; branched internal-olefins; and combinations thereof; and/or iv) where the olefin monomer feed mixture comprises a mixture of linear alpha-olefins and/or linear internal-olefins; and/or v) wherein the olefin monomer feed mixture comprises olefin monomers selected from the group consisting of unsaturated olefin comprises, linear alpha-olefins; linear internal-olefins; branched alpha-olefins; branched internal-olefins; and combinations thereof; and/or vi) wherein the olefin monomer feed mixture comprises a first feedstock comprising less than 36% by weight of branched olefin monomers, less than 20% by weight of branched olefin monomers, less than 10% by weight of branched olefin monomers, or less than 5% by weight of branched olefin monomers.

4. The process of claim 1, wherein an amount of decene in any of first and/or second feedstocks of the olefin monomer feed mixture is less than 20% by weight, less than 10% by weight, or less than 5% by weight; and/or i) further comprising oligomerizing the olefin monomer feed mixture under conditions to at least partially isomerize the dimers, trimers, and higher oligomers; and/or ii) wherein unreacted monomer is distilled from unsaturated oligomers and recycled in a subsequent oligomerization reaction; and/or iii) wherein isomerizing of the oligomer product is performed in the absence of hydrogen; and/or iv) wherein an amount of cracked byproducts generated during isomerizing of the oligomer product is less than 10%, less than 5%, or less than 1%.

5. The process according to claim 1, wherein isomerizing of the oligomer product is performed at a temperature in the range of from 125° C. to 300° C., and a pressure in the range of from 1 PSI to 100 PSI of inert gas, in the presence of an acid catalyst selected from the group consisting of solid metals or metal oxides or their mixture of Group IVB, VB, VIB and Group III; metal oxides or mixed oxides of Group IIA to VA; mixed metal oxides comprising $WO_x/ZrO_2$ type catalyst; solid natural or synthetic zeolites; and layered material, crystalline or amorphous material of silica, alumina, silicoaluminate, aluminophosphate, aluminum silicophosphate.

6. The process according to claim 1, wherein i) the dimer portion of the isomerized oligomer product is separated by distillation from the isomerized oligomer product; and/or ii) the oligomerization reaction is carried out at a temperature range from 10-110° C.; and/or iii) the oligomerization reaction includes a promoter that is an alcohol and/or an ester; and/or iv) wherein the oligomerization is carried out in at least one continuously stirred reactor under oligomerization conditions with an average residence time of 60 to 400 minutes; and/or v) the oligomerization is carried out in at least one continuously stirred reactor under oligomerization conditions with an average residence time of 90 to 300 minutes or 120 to 240 minutes; and/or vi) wherein the acid catalyst is a zeolite having a Constraint Index of about 2 to about 12.

7. The process of claim 1, wherein i) the acid catalyst is a zeolite containing one or more Group VI B to VIII B metal elements; and/or ii) the pour point of the isomerization product is at least −9° C. less, at least −15° C., or at least −21° C. than that of the oligomer product prior to isomerization; and/or iii) the dimer portion of the hydrogenated oligomer product has <5 wt %, <2.5 wt %, or <1 wt % naphthalenes after isomerization and hydrogenation; and/or iv) a percent yield of isomerized dimers produced in the isomerization is >90 wt %, >95 wt %, >97.5 wt %, or >99 wt %.

8. The process of claim 1, wherein a percent yield of isomerized dimers produced in the isomerization is >90 wt-%, >95 wt %, >97.5 wt %, or >99 wt %.

9. The process according to claim 1, wherein the saturated hydrocarbon base oil has a kinematic viscosity of measured at 100° C. by ASTM D445 of 3.7 cSt to 4.8 cSt, or 3.8 cSt to 4.5 cSt.

10. The process according to claim 1, wherein the saturated hydrocarbon base oil has a Viscosity Index of 125 or greater, 130 or greater, 135 or greater, 140 or greater, or 150 or greater.

11. The process according to claim 1, wherein the saturated hydrocarbon base oil has a CCS at −35° C. less than 1800 cP, less than 1700 cP, less than 1600 cP, less than 1500 cP, less than 1400 cP, less than 1300 cP, less than 1200 cP, or less than 1100 cP.

12. The process according to claim 1, wherein the saturated hydrocarbon base oil has a Noack volatility less than 14%.

13. The process according to claim 1, wherein the saturated hydrocarbon base oil can be characterized by a Noack volatility of less than 13%, less than 12%, less than 11%, less than 10%, less than 9%, less than 8%, less than 7%, or less than 6%.

14. The process according to claim 1, wherein the saturated hydrocarbon base oil can be characterized by pour point of less than −27° C., less than −30° C., less than −33° C., less than −36° C., less than −39° C., or less than −42° C.

15. The process according to claim 1, where the catalyst provided during isomerization is not the same as the catalyst provided during oligomerization.

* * * * *